US009707786B2

(12) United States Patent
Kageyama

(10) Patent No.: US 9,707,786 B2
(45) Date of Patent: Jul. 18, 2017

(54) SELF-INKING STAMP AND PRODUCTION METHOD THEREFOR

(71) Applicant: SHACHIHATA INC., Nagoya-shi, Aichi (JP)

(72) Inventor: Tomohiro Kageyama, Nagoya (JP)

(73) Assignee: Shachihata Inc., Nagoya-shi (JP)

( * ) Notice: Subject to any disclaimer, the term of this patent is extended or adjusted under 35 U.S.C. 154(b) by 0 days.

(21) Appl. No.: 14/300,740

(22) Filed: Jun. 10, 2014

(65) Prior Publication Data

US 2014/0366758 A1 Dec. 18, 2014

(30) Foreign Application Priority Data

Jun. 12, 2013 (JP) ..... 2013-123437
Jun. 12, 2013 (JP) ..... 2013-123438

(51) Int. Cl.

| | |
|---|---|
| ***B41K 1/56*** | (2006.01) |
| ***B41K 1/52*** | (2006.01) |
| ***B41K 1/00*** | (2006.01) |
| ***B41K 1/02*** | (2006.01) |
| ***B41K 1/38*** | (2006.01) |
| ***B41K 1/50*** | (2006.01) |

(52) U.S. Cl.

CPC ..... *B41K 1/52* (2013.01); *B41K 1/00* (2013.01); *B41K 1/02* (2013.01); *B41K 1/38* (2013.01); *B41K 1/50* (2013.01); *Y10T 29/49826* (2015.01)

(58) Field of Classification Search

CPC ..... B41K 1/52
USPC ..... 101/405
See application file for complete search history.

(56) References Cited

U.S. PATENT DOCUMENTS 2,600,413 A * 6/1952 Mason ..... B41K 1/24 101/125
3,719,140 A * 3/1973 Hammel ..... B41K 1/24 101/125

(Continued)

FOREIGN PATENT DOCUMENTS

DE 19846740 A1 3/2000
JP 53-010315 U 1/1978

(Continued)

OTHER PUBLICATIONS

Extended European Search Report dated Dec. 3, 2014, issued in corresponding European Application No. 14171830.4. (5 pages).

*Primary Examiner* — Anthony Nguyen
(74) *Attorney, Agent, or Firm* — Westerman, Hattori, Daniels & Adrian, LLP

(57) ABSTRACT

Self-inking stamp comprises: a porous marking block; an ink storage body disposed on an upper surface of the porous marking block; an absorber disposed on an upper surface of the ink storage body and configured to generate a capillary force less than that of the ink storage body, and absorb excess ink from the ink storage body; an ink tank comprising an ink supply tube having an open distal end connected to the ink storage body; a wall member covering an outer lateral peripheral surface of the ink storage body in such a manner as to prevent ink leakage; an ink outlet opening provided in a part or an entirety of a lower surface of the ink storage body; and an air passage opening provided in at least a part of an outer lateral peripheral surface of the absorber in communicating relation with atmospheric air.

20 Claims, 25 Drawing Sheets

(56) References Cited

U.S. PATENT DOCUMENTS

| | | | | | |
|---|---|---|---|---|---|
| 3,885,495 | A * | 5/1975 | Funahashi | B41K 1/52 | 101/327 |
| 5,123,349 | A * | 6/1992 | Beaver | B41K 1/50 | 101/333 |
| 5,826,515 | A * | 10/1998 | Frable | B41K 1/50 | 101/327 |
| 5,855,170 | A * | 1/1999 | Shih | B41K 1/52 | 101/327 |
| 5,979,323 | A * | 11/1999 | Hirano | B41K 1/50 | 101/108 |
| 5,996,493 | A * | 12/1999 | Okumura | B41K 1/02 | 101/108 |
| 5,996,495 | A * | 12/1999 | Hara | B41F 35/06 | 101/423 |
| 6,739,255 | B2 | 5/2004 | Blees et al. | | |
| 6,968,781 | B1 * | 11/2005 | Petersen | B41K 1/50 | 101/327 |
| 8,104,402 | B2 * | 1/2012 | Feilecker | B41K 1/02 | 101/327 |
| 2002/0073861 | A1 | 6/2002 | Blees et al. | | |
| 2013/0305940 | A1 | 11/2013 | Zehetner et al. | | |
| 2013/0312627 | A1 * | 11/2013 | Zehetner | B41K 1/38 | 101/333 |

FOREIGN PATENT DOCUMENTS

| | | |
|---|---|---|
| JP | 6-42200 U | 6/1994 |
| WO | 02/42844 A2 | 5/2002 |

* cited by examiner

SELF-INKING STAMP AND PRODUCTION METHOD THEREFOR

FIELD OF THE INVENTION

The present invention relates to a self-inking stamp using a porous marking (stamping) block with a large number of interconnected pores.

As used in this specification, the terms "down or lower" and "up or upper" mean, respectively, a downward direction along a direction of gravitational force, and an upward direction opposite to the direction of gravitational force.

BACKGROUND OF THE INVENTION

A stamp using a porous marking block with a large number of interconnected pores is widely used because it is capable of performing a marking operation without applying ink to a marking surface of the marking block in each marking operation.

Heretofore, this type of stamp has been configured such that ink stored in the ink storage body naturally flows down (permeates) into a porous marking block to permeatingly supply ink to a marking surface of the marking block, wherein ink replenishment for the stamp is performed by manually dropping liquid ink onto the marking surface or the ink storage body. During dropping of liquid ink, it is difficult for a user to accurately recognize an appropriate amount of liquid ink to be replenished, because a time required for ink permeation in the marking surface (state recovery in the marking surface) varies with position. Thus, the user is apt to replenish an excessive amount of liquid ink.

With a view to solving this problem, there has been proposed a stamp in which an ink cartridge containing ink is disposed on a back side of an ink-impregnated body, in such a manner that an ink supply port of the ink cartridge is in contact with the ink-impregnated body, as disclosed in the following Patent Document 1.

There has also been proposed a stamp in which an ink cartridge containing ink is disposed on a back side of a porous-rubber character block, in such a manner that an ink supply tube of the ink cartridge is inserted into the character block, as disclosed in the following Patent Document 2.

LIST OF PRIOR ART DOCUMENTS

Patent Document 1: JP-U 06-042200A
Patent Document 2: JP-U 53-010315A

SUMMARY OF THE INVENTION

In the stamp illustrated in the Patent Document 1, ink contained in the ink cartridge is gradually supplied to the ink-impregnated body via the ink supply port, and, then when it finally reaches a maximum permissible impregnation amount for the ink-impregnated body, the ink-impregnated body is filled with ink. In this state, when an internal pressure of the ink cartridge is raised, for example, due to a sharp rise in temperature, ink is pushed out of a marking surface of a microporous block, causing ink leakage.

In the stamp illustrated in the Patent Document 2, ink is supplied to the character block via the tube, and, then when it finally reaches a maximum permissible impregnation amount for the character block, the character block is filled with ink. In this state, when an internal pressure of the ink cartridge is raised, for example, due to a sharp rise in temperature, ink is pushed out of a marking surface of the character block, causing ink leakage.

The present invention has been accomplished to solve the above problems, and provides a self-inking stamp which comprises: a porous marking block having a large number of interconnected pores; an ink storage body disposed on an upper surface of the porous marking block; and an ink tank comprising an ink supply tube having an open distal end connected to the ink storage body. The self-inking stamp is characterized in that it further comprises an absorber disposed on an upper surface of the ink storage body and configured to generate a capillary force less than that of the ink storage body, and absorb excess ink from the ink storage body, wherein the absorber has an air passage opening provided in at least a part of an upper surface or outer lateral peripheral surface thereof in communicating relation with atmospheric air.

As provided in a first aspect of the self-inking stamp in accordance with the invention, the self-inking stamp further comprises a wall member covering an entire outer lateral peripheral surface of the ink storage body and having an ink outlet opening provided in a lower surface thereof, wherein the wall member is composed of a fibrous body or a porous body which is configured to generate a capillary force less than that of the ink storage body and allow air to pass therethrough, and disposed in such a manner that a lower surface of the fibrous body or the porous body is in contact with the upper surface of the porous marking block.

As further provided in the first aspect of the self-inking stamp in accordance with the invention, the wall member is composed of a barrier body capable of blocking ink, and disposed in such a manner that a lower surface of the barrier body is in contact with the upper surface of the porous marking block.

As provided in a second aspect of the self-inking stamp in accordance with the invention, the ink supply tube is disposed on the side of the upper surface of the ink storage body, in such a manner that the distal end of the ink supply tube is connected to the upper surface of the ink storage body.

As provided in a third aspect of the self-inking stamp in accordance with the invention, the ink supply tube is disposed on the side of the upper surface of the ink storage body, in such a manner that the distal end of the ink supply tube is connected to an inside of the ink storage body.

As provided in a fourth aspect of the self-inking stamp in accordance with the invention, the ink supply tube is disposed on the side of an outer lateral peripheral surface of the ink storage body, in such a manner that the distal end of the ink supply tube is connected to the outer lateral peripheral surface of the ink storage body.

As provided in a fifth aspect of the self-inking stamp in accordance with the invention, the ink supply tube is disposed on the side of an outer lateral peripheral surface of the ink storage body, in such a manner that the distal end of the ink supply tube is connected to an inside of the ink storage body.

As provided in a sixth aspect of the self-inking stamp in accordance with the invention, the number of the ink supply tubes is one, or two or more.

As provided in a seventh aspect of the self-inking stamp in accordance with the invention, the self-inking stamp further comprises a replaceable ink cartridge containing ink and having an open end, wherein the ink tank has an opening portion at an upper end thereof, and wherein the open end of the replaceable ink cartridge is detachably and fittingly attached to the opening portion of the ink tank in such a manner as to hermetically seal the opening portion.

As further provided in the seventh aspect of the self-inking stamp in accordance with the invention, the replaceable ink cartridge comprises a plug member installed in the open end thereof and configured to be opened when the open end of the replaceable ink cartridge is fittingly attached to the opening portion of the ink tank.

As still further provided in the seventh aspect of the self-inking stamp in accordance with the invention, the replaceable ink cartridge comprises a plug member installed in the open end thereof and configured to be closed when the open end of the replaceable ink cartridge is detached from the opening portion of the ink tank.

The present invention also provides a method of producing a self-inking stamp, wherein the self-inking stamp comprises: a porous marking block having a large number of interconnected pores; an ink storage body disposed on an upper surface of the porous marking block; an ink tank comprising an ink supply tube having an open distal end connected to the ink storage body; and an absorber disposed on an upper surface of the ink storage body and configured to generate a capillary force less than that of the ink storage body, and absorb excess ink from the ink storage body, the absorber having an air passage opening provided in at least a part of an upper surface or outer lateral peripheral surface thereof in communicating relation with atmospheric air. The method is characterized in that it comprises: preparing a single body for the ink storage body and the absorber by using a same material; and inwardly pressing the single body by the ink supply tube, to thereby form the ink storage body and the absorber, wherein the ink storage body is pressed by a pressing force greater than that for the absorber.

As provided in a first aspect of the method of producing a self-inking stamp in accordance with the invention, the distal end of the ink supply tube is pressingly inserted into the single body from the side of an upper surface of the single body, whereby the ink supply tube is disposed on the side of the upper surface of the ink storage body, in such a manner that the distal end of the ink supply tube is connected to the upper surface of the ink storage body.

As provided in a second aspect of the method of producing a self-inking stamp in accordance with the invention, the distal end of the ink supply tube is pressingly inserted into the single body from the side of an upper surface of the single body, whereby the ink supply tube is disposed on the side of the upper surface of the ink storage body, in such a manner that the distal end of the ink supply tube is connected to an inside of the ink storage body.

As provided in a third aspect of the method of producing a self-inking stamp in accordance with the invention, the distal end of the ink supply tube is pressingly inserted into the single body from the side of an outer lateral peripheral surface of the single body, whereby the ink supply tube is disposed on the side of the outer lateral peripheral surface of the ink storage body, in such a manner that the distal end of the ink supply tube is connected to the outer lateral peripheral surface of the ink storage body.

As provided in a fourth aspect of the method of producing a self-inking stamp in accordance with the invention, the distal end of the ink supply tube is pressingly inserted into the single body from the side of an outer lateral peripheral surface of the single body, whereby the ink supply tube is disposed on the side of the outer lateral peripheral surface of the ink storage body, in such a manner that the distal end of the ink supply tube is connected to an inside of the ink storage body.

As provided in a fifth aspect of the method of producing a self-inking stamp in accordance with the invention, the number of the ink supply tubes is one, or two or more.

As provided in a sixth aspect of the method of producing a self-inking stamp in accordance with the invention, the self-inking stamp further comprises a replaceable ink cartridge containing ink and having an open end, and wherein the method comprising: providing an opening portion at an upper end of the ink tank; and detachably and fittingly attaching the open end of the replaceable ink cartridge to the opening portion of the ink tank in such a manner as to hermetically seal the opening portion.

As further provided in the sixth aspect of the method of producing a self-inking stamp in accordance with the invention, the replaceable ink cartridge comprises a plug member installed in the open end thereof and configured to be opened when the open end of the replaceable ink cartridge is fittingly attached to the opening portion of the ink tank.

As still further provided in the sixth aspect of the method of producing a self-inking stamp in accordance with the invention, the replaceable ink cartridge comprises a plug member installed in the open end thereof and configured to be closed when the open end of the replaceable ink cartridge is detached from the opening portion of the ink tank.

In the self-inking stamp in accordance with the present invention, the absorber configured to generate a capillary force less than that of the ink storage body is disposed on the side of an upper surface of the ink storage body to thereby allow ink to be preferentially retained in the ink storage body. Thus, even when an internal pressure of the ink tank rises, for example, due to a sharp rise in temperature, ink is moved toward the absorber without being pushed out of the marking surface.

In a further aspect of the first aspect of the self-inking stamp in accordance with the invention, the wall member covering the outer lateral peripheral surface of the ink storage body is composed of a fibrous body or a porous body which is configured to generate a capillary force less than that of the ink storage body and allow air to pass therethrough. Thus, even when the internal pressure of the ink tank rises as mentioned above, ink is moved toward not only the absorber but also the fibrous body or the porous body, without being pushed out of the marking surface.

In a still further aspect of the first aspect of the self-inking stamp in accordance with the invention, the wall member covering the outer lateral peripheral surface of the ink storage body is composed of a barrier body capable of blocking ink. Thus, even when the internal pressure of the ink tank rises as mentioned above, ink is moved toward the absorber without being pushed out of the marking surface.

In a further aspect of the second aspect of the self-inking stamp in accordance with the invention and a further aspect of the first aspect of the method of producing a self-inking stamp in accordance with the invention, the ink supply tube is disposed on the side of the upper surface of the ink storage body, in such a manner that the distal end of the ink supply tube is connected to the upper surface of the ink storage body, so that it becomes possible to smoothly infiltrate ink into the ink storage body.

In a further aspect of the third aspect of the self-inking stamp in accordance with the invention and a further aspect of the second aspect of the method of producing a self-inking stamp in accordance with the invention, the ink supply tube is disposed on the side of the upper surface of the ink storage body, in such a manner that the distal end of the ink supply tube is connected to an inside of the ink storage body, so that it becomes possible to smoothly infiltrate ink into the ink storage body, and provide stronger connection between the ink supply tube and the ink storage body.

In a further aspect of the fourth aspect of the self-inking stamp in accordance with the invention and a further aspect of the third aspect of the method of producing a self-inking stamp in accordance with the invention, the ink supply tube is disposed on the side of an outer lateral peripheral surface of the ink storage body, in such a manner that the distal end of the ink supply tube is connected to the outer lateral peripheral surface of the ink storage body, so that it becomes possible to smoothly infiltrate ink into the ink storage body.

In a further aspect of the fifth aspect of the self-inking stamp in accordance with the invention and a further aspect of the fourth aspect of the method of producing a self-inking stamp in accordance with the invention, the ink supply tube is disposed on the side of an outer lateral peripheral surface of the ink storage body, in such a manner that the distal end of the ink supply tube is connected to an inside of the ink storage body, so that it becomes possible to smoothly infiltrate ink into the ink storage body, and provide stronger connection between the ink supply tube and the ink storage body.

In a further aspect of the sixth aspect of the self-inking stamp in accordance with the invention and a further aspect of the fifth aspect of the method of producing a self-inking stamp in accordance with the invention, the number of the ink supply tubes may be set ton one, or two or more. This is advantageous in view of practical use.

In a further aspect of the seventh aspect of the self-inking stamp in accordance with the invention and a further aspect of the sixth aspect of the method of producing a self-inking stamp in accordance with the invention, when ink contained in the fully consumed, ink can be replenished by replacing the replaceable ink cartridge fittingly attached to the upper end of the ink tank, with a new one. In addition, during the ink replenishment, there is no need to reset a connection between the ink supply port and the ink storage body, i.e., once a connection therebetween is set up, the connection is maintained, so that it becomes possible to stably supply ink without ink leakage.

In a still further aspect of the seventh aspect of the self-inking stamp in accordance with the invention and a still further aspect of the sixth aspect of the method of producing a self-inking stamp in accordance with the invention, the plug member provided in the replaceable ink cartridge is configured to be opened when the replaceable ink cartridge is fittingly attached to the ink tank, so that the ink replenishment operation can be easily performed while preventing leakage of ink from the replaceable ink cartridge.

In a still further aspect of the seventh aspect of the self-inking stamp in accordance with the invention and a still further aspect of the sixth aspect of the method of producing a self-inking stamp in accordance with the invention, in the case where the self-inking stamp comprise a valve device configured such that the plug member is opened when being pushed by a plug pushing member, even when an old replaceable ink cartridge 15 in which ink remains is detached from the ink tank, the open end is closed by the action of the valve device, so that it becomes possible to prevent ink leakage.

In a still further aspect of the method of producing a self-inking stamp in accordance with the invention, the absorber configured to generate a capillary force less than that of the ink storage body is disposed on the side of an upper surface and an outer lateral peripheral surface of the ink storage body to thereby allow ink to be preferentially retained in the ink storage body. Thus, even when an internal pressure of the ink tank rises, for example, due to a sharp rise in temperature, ink is moved toward the absorber without being pushed out of the marking surface.

Further, by pressingly inserting the ink supply tube into the single body, the ink storage body configured to generate a relatively strong capillary force can be formed around a distal end of the inserted ink supply tube, so that it becomes possible to eliminate a need for preliminarily arranging the ink storage body. This is advantageous in view of practical use. In the present invention, it is essential that the ink supply tube is connected to the ink storage body. Thus, the technique of forming the ink storage body through an operation for the connection therebetween is useful for improving production efficiency.

DETAILED DESCRIPTION OF THE PREFERRED EMBODIMENTS

Figure 1:
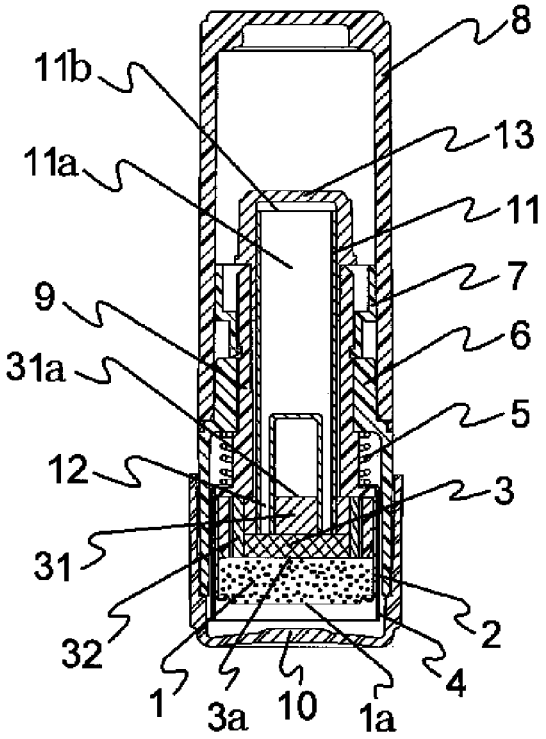
FIG. 1 is a schematic diagram illustrating first, second and fourth embodiments of the present invention.

Base on FIG. 1, a self-inking stamp according to a first embodiment of the present invention will now be described in detail.

A porous marking block 1 comprises a sponge body made of rubber, synthetic resin or the like and formed to have a large number of interconnected pores, wherein a lower surface thereof is formed as a marking surface 1*a* for marking characters or the like.

A bracket 2 is made of a material free of impregnation with ink, such as stainless steel, and formed to allow the porous marking block 1 to be fittingly attached to a lower end of a stamp casing 9 while fittingly holding the porous marking block 1.

An ink storage body 3 is disposed on the side of an upper surface of the porous marking block 1.

The ink storage body 3 may be any type having a capillary space. Examples thereof include a resin-processed body of a fiber bundle, a fusion-bonded body of a fiber bundle, a felted body, a needlepunched body of felt, a porous material such as porous synthetic resin foam, and a synthetic resin extrusion-molded body having an axial ink guidepath. As a material for the ink storage body 3, it is possible to use a synthetic resin fiber, such as acrylic fiber or polyester fiber.

A part or an entirety of a lower surface of the ink storage body 3 is opened to form an ink outlet opening 3*a*. The ink outlet opening 3*a* provided in the ink storage body 3 is in contact with the upper surface of the porous marking block 1. A relationship in terms of capillary force between the porous marking block 1 and the ink storage body 3 is adjusted to allow an appropriate amount of ink to be moved to the marking surface 1*a*.

An absorber 31 is disposed on an upper surface of the ink storage body 3, and configured to generate a capillary force less than that of the ink storage body 3. The absorber 31 may be any type having a capillary space. Examples thereof include a resin-processed body of a fiber bundle, a fusion-bonded body of a fiber bundle, a felted body, a needlepunched body of felt, a porous material such as porous synthetic resin foam, and a synthetic resin extrusion-molded body having an axial ink guidepath. As a material for the absorber 31, it is possible to use a synthetic resin fiber, such as acrylic fiber or polyester fiber.

As used herein, the term "capillary force" means a force causing capillary rise, and a force causing ink to move through the capillary space. Thus, the configuration in which a capillary force of the absorber 31 is less than that of the ink storage body 3 means that ink is less likely to be moved to the absorber 31.

The absorber 31 is also configured such that a part or an entirety of an outer surface thereof is provided with an air passage opening 31*a* opened to communicate with atmospheric air, to thereby allow a replacement of outflow ink by external air to be performed.

In this embodiment, the porous marking block 1 and the absorber 31 may be integrally formed as a single body. In this case, it is conceivable to employ a technique of locally changing a fiber content during producing the single body, or a technique of uniformly setting a fiber content distribution in the single body and locally reducing a volume of the single body, correspondingly to the ink storage body 3. For example, as the technique of locally reducing a volume of the single body, correspondingly to the ink storage body 3, it is conceivable to employ a technique of pressing and compressing a part of an outer peripheral surface of the single body radially inwardly to form the ink storage body 3, or a technique of pressing and compressing a part of a lower end surface of the single body upwardly to form the ink storage body 3.

Respective outer lateral peripheral surfaces of the ink storage body 3 and the absorber 31 are covered by a wall member 32. The wall member 32 is provided to prevent ink infiltrated in the ink storage body 3 from leaking from the outer lateral peripheral surface of the ink storage body 3. In the present invention, as the wall member, it is possible to employ a fibrous body, a porous body, or a barrier body capable of blocking ink.

The wall member 32 is configured to generate a capillary force less than that of the ink storage body 3. The wall member 32 is configured to allow air to pass therethrough, and disposed in such a manner that a lower surface thereof is in contact with the upper surface of the porous marking block. The configuration in which a capillary force of the wall member 32 is less than that of the ink storage body 3 means that ink is less likely to be moved to the wall member 32.

The wall member 32 may be any type having a capillary space. Examples thereof include a resin-processed body of a fiber bundle, a fusion-bonded body of a fiber bundle, a felted body, a needlepunched body of felt, a porous material such as porous synthetic resin foam, and a synthetic resin extrusion-molded body having an axial ink guidepath. As a material for the wall member 32, it is possible to use a synthetic resin fiber, such as acrylic fiber or polyester fiber. The wall member 32 may be made of the same material as that of the absorber 31, or may be made of a different material from that of the absorber 31.

The self-inking stamp may further comprise an outer skin composed of a synthetic resin film or the like and formed on an outer peripheral surface of the wall member 32.

In addition to a resin-processed body of a fiber bundle, a fusion-bonded body of a fiber bundle, a felted body, a needlepunched body of felt, a porous material such as porous synthetic resin foam, and the like, any other porous body may be employed as the wall member 32. As used herein, the term "porous body" means a product formed by a conventional method using a raw material such as thermoplastic resin, thermosetting resin, rubber, glass, ceramics, or metal, in such a manner as to internally have interconnected pores. In this embodiment, a porous body employed as the wall member 32 is configured to generate a capillary force less than that of the ink storage body 3.

Alternatively, the wall member 32 may be composed of a barrier body 33 capable of blocking ink. As a material for the barrier body 33, it is possible to employ any type capable of blocking ink, such as a resin such as plastic, resin film, or metal.

A slide 4 has an upper surface which is, in a normal state, always pressed downwardly against the stamp casing 9 by a coil spring 5, in such a manner that a lower end thereof always protrudes downwardly with respect to the marking surface 1*a*.

A sheath 6 is disposed to receive the spring 5, and fixed to the stamp casing 9 through a fixing ring 7 made of a polyacetal resin or the like.

A grip body 8 is detachably and fittingly attached onto the sheath 6 and the fixing ring 7.

The stamp casing 9 is made of a synthetic resin excellent in ink resistance, such as polyacetal resin, and formed to allow the ink storage body 3 and the porous marking block 1 allow the bracket 2 fittingly holding the porous marking block 1 with the ink storage body 3 to be fittingly attached to the lower end thereof.

With a view to protecting the marking surface 1*a*, a marking surface cap 10 may be fitted onto a lower end of the sheath 6 in such a manner as to cover the marking surface 1*a*.

An ink tank 11 is composed of a bottomed tubular body having an open upper end, and provided with an ink supply tube 12 extending downwardly from a lower surface of a bottom wall thereof to have an open distal end, wherein the ink supply tube 12 penetrates through the bottom wall. Ink is contained in an inner space 11*a* of the tubular body.

The number of the ink supply tubes 12 may be two or more, i.e., plural, or may be one, as in an aftermentioned eighth embodiment illustrated in FIGS. 11 to 15. The first embodiment will be described on the assumption that the self-inking stamp comprises a plurality of ink supply tubes 12.

Figure 2:
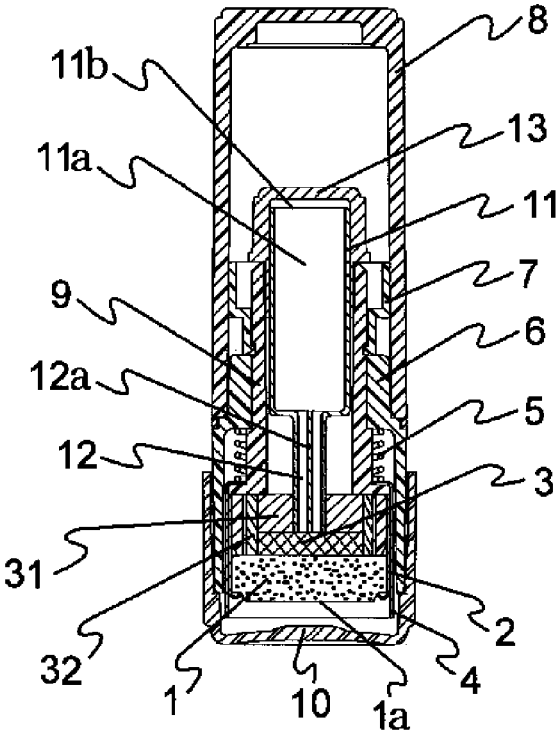
FIG. 2 is a schematic diagram illustrating another example of a plurality of ink supply tubes in the first, second and fourth embodiments.

A cross-sectional shape of an outer or inner peripheral surface of each of the ink supply tubes 12 may be a circular shape, an elliptical shape or a polygonal shape such as a triangular shape or a quadrangular shape. The distal end of each of the ink supply tubes 12 may be opened downwardly in an up-down direction, or may be opened radially outwardly. Examples of a shape of the distal end of each of the ink supply tubes 12 include an obliquely cut surface, a vertical surface, a conical surface and a convexedly curved surface. As illustrated in FIG. 2, the plurality of ink supply tubes 12 may be composed of two ink supply tubes 12 configured such that respective lateral walls thereof are mutually coupled together. This is equivalent to a configuration in which an internal space of a single tubular member is divided by a partition wall 12*a* extending in the up-down direction to thereby provide two ink supply tubes 12 in the tubular member independently in parallel relation to each other.

Figure 3:
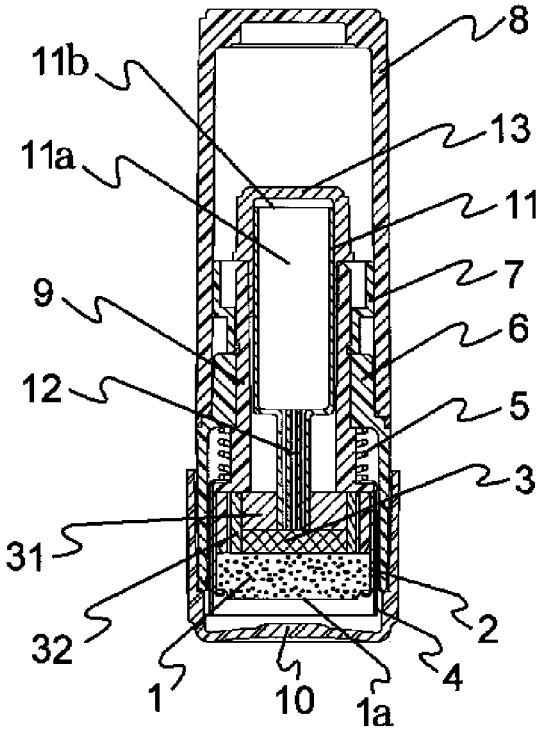
FIG. 3 is a schematic diagram illustrating yet another example of the ink supply tubes in the first, second and fourth embodiments.

Alternatively, as illustrated in FIG. 3, the plurality of ink supply tubes 12 may be composed of large-diameter and small-diameter ink supply tubes 12 configured such that the small-diameter ink supply tube 12 is disposed inside the large-diameter ink supply tube 12. In this case, a cross-sectionally annular flow passage is defined between the large-diameter and small-diameter ink supply tubes 12, and a cross-sectionally circular flow passage is formed inside the small-diameter ink supply tube 12.

An opening portion 11*b* of the ink tank 11 at the upper end thereof is hermetically sealed with respect to the outside. As a hermetically sealing method, it is conceivable to employ a technique of attaching an ink tank cap 13, or a technique of utilizing an integral molding process to hermetically seal the opening portion 11*b*.

In the technique of attaching the ink tank cap 13, the ink tank cap 13 is hermetically fitted onto the opening portion 11*b* of the ink tank 11. A fitting method between the ink tank 11 and the ink tank cap 13 may be screw fitting. In a state in which the ink tank cap 13 is fitted on the ink tank 11, the ink tank cap 13 is inserted into an open upper end of the stamp casing 9, in a posture where a lower end thereof serves as a leading end. A flange may be provided on an outer peripheral surface of the ink tank cap 13 and configured to be stopped by an edge face of the opening portion at the upper end of the stamp casing 9.

As the technique of utilizing an integral molding process to hermetically seal the opening portion 11*b*, it is conceivable to employ a technique of integrally molding the ink tank 11 and the ink tank cap 13 together, for example, a technique of: molding an ink tank 11 with a plurality of ink supply tubes 12 on one end thereof by injection molding; supplying ink into the ink tank 11; and subjecting the other end of the ink tank 11 to heat sealing, or a technique of molding an ink tank cap 13 by blow molding.

The stamp according to the first embodiment is assembled in the following manner. First of all, as illustrated in FIG. 1, the porous marking block 1 with the ink storage body 3 placed on the upper surface thereof is fittingly mounted to and held by the bracket 2, and, in this state, the bracket 2 is fittingly attached to the lower end of the stamp casing 9. Then, the slide 4, the spring 5, the sheath 6 and the fixing ring 7 are inserted from the side of the open upper end of the stamp casing 9, and the sheath 6 is fixed to the stamp casing 9 by the fixing ring 7. Subsequently, the ink tank 11 is inserted into the open upper end of the stamp casing 9 and fitted in the stamp casing 9.

As a result of the insertion of the ink tank 11, the distal end of each of the ink supply tubes 12 is connected to the ink storage body 3. As used herein, the term "connect" means joining the ink supply tube 12 and the ink storage body 3 together. As means to connect and join the ink supply tube 12 and the ink storage body 3 together, it is conceivable to employ contact bonding, pressure bonding or adhesive bonding.

The term "contact bonding" means joining two members together in a contact manner. Examples of the contact bonding include inserting the ink supply tube 12 into a connection hole preliminarily provided in the ink storage body 3. In this case, the ink storage body 3 and the ink supply tube 12 are contact-bonded together by a frictional force between an inner peripheral surface of the connection hole of the ink storage body 3 and an outer peripheral surface of the ink supply tube 12.

The term "pressure bonding" means bringing two members into press-contact with each other. Examples of the pressure bonding include forcibly inserting the ink supply tube 12 into the ink storage body 3. In this case, the ink storage body 3 and the ink supply tube 12 are pressure-bonded together by a frictional force between a fiber bundle of the ink storage body and the outer peripheral surface of the ink supply tube 12.

The term "adhesive bonding" means joining two surfaces by a chemical force or the like using an adhesive as a medium. Examples of the adhesive bonding include applying an adhesive onto the outer peripheral surface of the ink supply tube 12, and then inserting the ink supply tube 12 into a connection hole preliminarily provided in the ink storage body 3 to thereby adhesively bond an inner peripheral surface of the connection hole and the outer peripheral surface of the ink supply tube 12 together by a chemical force. In this case, the open distal end of the ink supply tube 12 must not be closed up by the adhesive.

The connection method in the first embodiment comprises: preliminarily providing a plurality of connection through-holes in the absorber 31 to extend downwardly from the upper surface of the absorber 31; and then inserting the ink supply tubes 12 into the respective connection through-holes. The ink supply tubes 12 are configured such that, as a result of the insertion, the distal end of the ink supply tubes 12 is connected to the ink storage body 3. Then, the grip body 8 is fitted onto the sheath 6 and the fixing ring 7, and the marking surface cap 10 is fittingly attached to the lower end of the sheath 6.

As ink for use in the present invention, it is possible to appropriately employ water-based ink, oil-based ink, dye-based ink, or pigment-based ink.

The self-inking stamp according to the first embodiment is configured as above. Functions of this self-inking stamp will be described below.

The ink supply tubes 12 have a function of supplying ink contained in the ink tank 11, into the ink storage body 3, and a function of supplying external air into the ink tank 11. When the marking surface 1*a* is oriented downwardly, ink contained in the ink tank 11 is gravitationally supplied to the ink storage body 3 via at least one of the ink supply tubes 12, i.e., the function of supplying ink from the ink tank 11 into the ink storage body 3 is activated. Concurrently, external air is introduced into the ink tank 11 via a remaining at least one of the ink supply tubes 12. Thus, ink contained in the ink tank 11 will be gradually infiltrated into the ink storage body 3. The supply of ink will continue until a level of ink infiltrated in the ink storage body 3 reaches the open distal end of the remaining ink supply tube 12 which is introducing external air therethrough.

When the level of ink infiltrated in the ink storage body 3 reaches the open distal end of the remaining ink supply tube 12 which is introducing external air therethrough, the open distal end is airtightly closed, so that a supply of external air into the ink tank 11 is stopped. Then, a supply of ink from the ink tank 11 to the ink storage body 3 via the ink supply tube 12 is also stopped.

In this way, outflow of ink from the ink tank 11 and inflow of air into the ink tank 11 (i.e., replacement between ink and air) are stopped, and the ink tank is temporarily maintained in a hermetically sealed state.

When a marking operation is continuously performed in this state, ink is supplied from the ink outlet opening 3*a* provided in the ink storage body 3 to the porous marking block 1, by an amount corresponding to consumption of ink in the porous marking block 1. Then, when ink infiltrated in the ink storage body 3 is reduced, the hermetically sealed state is released, and ink is supplied from the ink tank 11 to the ink storage body 3 via the ink supply tube 12 by an amount corresponding to the ink supplied from the ink storage body 3 to the porous marking block 1. Thus, the marking operation can be performed until ink contained in the ink tank 11 is fully consumed.

When an external temperature changes in a situation where the ink tank 11 is in the hermetically sealed state, an internal pressure of the ink tank is changed. For example, when the external temperature rises as compared to that at the time the ink tank 11 comes into the hermetically sealed state, the internal pressure of the ink tank becomes higher due to expansion of air within the ink tank, and thereby ink is discharged from the ink supply tubes 12. The discharged ink is absorbed by the absorber 31 provided with the air passage opening 31*a* communicating with atmospheric air, or absorbed or blocked by the wall member 32, thereby being kept from moving toward the porous marking block 1.

In this state, when the external temperature falls down, the internal temperature of the ink tank becomes lower, and thereby the previously discharged ink is sucked back into the ink tank via the ink supply tubes 12.

On the other hand, when the external temperature falls down as compared to that at the time the ink tank comes into the hermetically sealed state, the internal pressure of the ink tank becomes lower due to contraction of air within the ink tank, and thereby ink located around the open distal ends of the ink supply tubes 12 is sucked into the ink tank via the ink supply tubes 12. In this state, when the external temperature rises, the internal temperature of the ink tank becomes higher, and thereby the previously sucked ink is discharged from the ink supply tubes 12.

In an ink replenishment operation, the grip body 8 is first detached, and the ink tank 11 with the ink tank cap 13 fitted thereon is extracted and replaced with a new ink tank 11.

Next based on FIGS. 1 to 3, a self-inking stamp according to a second embodiment of the present invention will now be described in detail. The following description will be made only about a difference from the first embodiment.

As the wall member, the self-inking stamp according to the second embodiment employs a wall member 32 configured to generate a capillary force less than that of the ink storage body 3. The wall member 32 is configured to allow air to pass therethrough, and disposed in such a manner that a lower surface thereof is in contact with the upper surface of the porous marking block. The configuration in which a capillary force of the wall member 32 is less than that of the ink storage body 3 means that ink is less likely to be moved to the wall member 32.

The wall member 32 may be any type having a capillary space. Examples thereof include a resin-processed body of a fiber bundle, a fusion-bonded body of a fiber bundle, a felted body, a needlepunched body of felt, a porous material such as porous synthetic resin foam, and a synthetic resin extrusion-molded body having an axial ink guidepath. As a material for the wall member 32, it is possible to use a synthetic resin fiber, such as acrylic fiber or polyester fiber.

The wall member 32 may be made of the same material as that of the absorber 31, or may be made of a different material from that of the absorber 31.

The self-inking stamp may further comprise an outer skin composed of a synthetic resin film or the like and formed on an outer peripheral surface of the wall member 32.

In addition to a resin-processed body of a fiber bundle, a fusion-bonded body of a fiber bundle, a felted body, a needlepunched body of felt, a porous material such as porous synthetic resin foam, and the like, any other porous body may be employed as the wall member 32. As used herein, the term "porous body" means a product formed by a conventional method using a raw material such as thermoplastic resin, thermosetting resin, rubber, glass, ceramics, or metal, in such a manner as to internally have interconnected pores. In this embodiment, a porous body employed as the wall member 32 is configured to generate a capillary force less than that of the ink storage body 3.

A cross-sectional shape of an outer or inner peripheral surface of each of a plurality of ink supply tubes 12 may be a circular shape, an elliptical shape or a polygonal shape such as a triangular shape or a quadrangular shape. A distal end of each of the ink supply tubes 12 may be opened downwardly in an up-down direction, or may be opened radially outwardly. Examples of a shape of the distal end of each of the ink supply tubes 12 include an obliquely cut surface, a vertical surface, a conical surface and a convexedly curved surface.

As illustrated in FIG. 2, the plurality of ink supply tubes 12 may be composed of two ink supply tubes 12 configured such that respective lateral walls thereof are mutually coupled together. This is equivalent to a configuration in which an internal space of a single tubular member is divided by a partition wall 12*a* extending in the up-down direction to thereby provide two ink supply tubes 12 in the tubular member independently in parallel relation to each other.

As illustrated in FIG. 3, the plurality of ink supply tubes 12 may be composed of large-diameter and small-diameter ink supply tubes 12 configured such that the small-diameter ink supply tube 12 is disposed inside the large-diameter ink supply tube 12. In this case, a cross-sectionally annular flow passage is defined between the large-diameter and small-diameter ink supply tubes 12, and a cross-sectionally circular flow passage is formed inside the small-diameter ink supply tube 12.

The self-inking stamp according to the second embodiment is configured as above. Functions of this self-inking stamp will be described in detail below.

In the second embodiment, when an external temperature changes in a situation where the ink tank 11 is in the hermetically sealed state, an internal pressure of the ink tank is changed. For example, when the external temperature rises as compared to that at the time the ink tank 11 comes into the hermetically sealed state, the internal pressure of the ink tank becomes higher due to expansion of air within the ink tank, and thereby ink is discharged from the ink supply tubes 12. The discharged ink is absorbed by the absorber 31 provided with the air passage opening 31*a* communicating with atmospheric air, or by the wall member 32, thereby being kept from moving toward the porous marking block 1, so that it becomes possible to prevent ink from being pushed out of the marking surface. In this state, when the external temperature falls down, the internal temperature of the ink tank becomes lower, and thereby the previously discharged ink is sucked back into the ink tank via the ink supply tubes 12.

On the other hand, when the external temperature falls down as compared to that at the time the ink tank comes into the hermetically sealed state, the internal pressure of the ink tank becomes lower due to contraction of air within the ink tank, and thereby ink located around the open distal ends of the ink supply tubes 12 is sucked into the ink tank via the ink supply tubes 12. In this state, when the external temperature rises, the internal temperature of the ink tank becomes higher, and thereby the previously sucked ink is discharged from the ink supply tubes 12.

Figure 4:
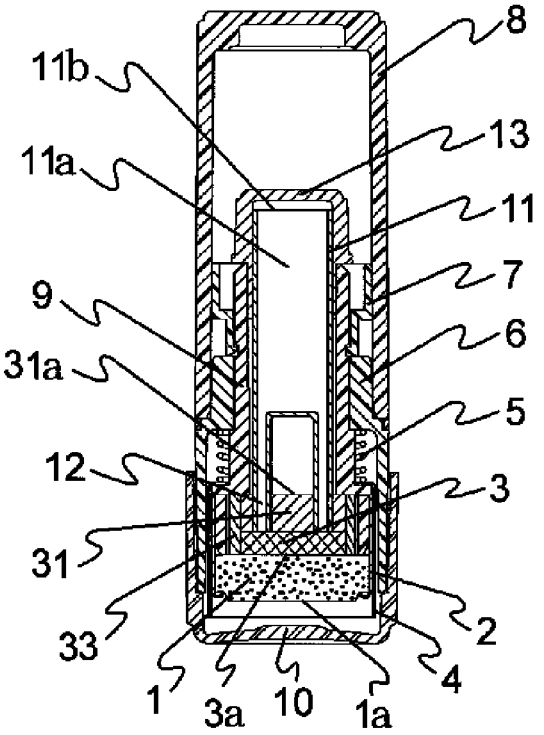
FIG. 4 is a schematic diagram illustrating a third embodiment of the present invention.

Next, based on FIG. 4, a self-inking stamp according to a third embodiment of the present invention will now be described in detail. The following description will be made only about a difference from the aforementioned embodiments.

As the wall member covering respective outer lateral peripheral surfaces of the ink storage body 3 and the absorber 31, the self-inking stamp according to the third embodiment employs a barrier body 33 capable of blocking ink. The barrier body 33 is disposed in such a manner that a lower surface thereof is in contact with the upper surface of the porous marking block. As a material for the barrier wall, it is possible to employ any type capable of blocking ink, such as a resin such as plastic, resin film, or metal. When the barrier wall is made of resin or metal, it may be formed as a hollow cylindrical body having opposite open ends. When the barrier wall is made of a resin film, it is conceivable to employ a configuration in which the resin film is wound around the outer lateral peripheral surfaces of the ink storage body 3 and the absorber 31.

The self-inking stamp according to the third embodiment is configured as above. Functions of this self-inking stamp will be described in detail below.

In the third embodiment, the barrier wall 33 is employed, instead of the wall member 32 in the second embodiment.

When an external temperature changes in a situation where the ink tank 11 is in the hermetically sealed state, an internal pressure of the ink tank is changed. For example, when the external temperature rises as compared to that at the time the ink tank 11 comes into the hermetically sealed state, the internal pressure of the ink tank becomes higher due to expansion of air within the ink tank, and thereby ink is discharged from the ink supply tubes 12. The discharged ink is blocked by the barrier body 33, and absorbed by the absorber 31 provided with the air passage opening 31*a* communicating with atmospheric air, thereby being kept from moving toward the porous marking block 1, so that it becomes possible to prevent ink from being pushed out of the marking surface. In this state, when the external temperature falls down, the internal temperature of the ink tank becomes lower, and thereby the previously discharged ink is sucked back into the ink tank via the ink supply tubes 12.

The remaining functions in the third embodiment are the same as those in the second embodiment.

Next, based on FIGS. 1 to 3, a self-inking stamp according to a fourth embodiment of the present invention will now be described in detail. The following description will be made only about a difference from the aforementioned embodiments.

In the fourth embodiment, the ink supply tubes 12 are disposed on the side of the upper surface of the ink storage body 3, in such a manner that the distal end of each of the ink supply tubes 12 is connected to the upper surface of the ink storage body 3. As a method for the connection, it is conceivable to preliminarily provide a plurality of connection through-holes for the ink supply tubes 12 in FIGS. 2 and 3, one connection through-hole in the absorber 31 to extend downwardly from the upper surface of the absorber 31, and then insert the ink supply tubes 12 into the respective connection through-holes (the one connection through-hole). The ink supply tubes 12 are configured such that, as a result of the insertion, the distal end of each of the ink supply tubes 12 is connected to the upper surface of the ink storage body 3.

The self-inking stamp according to the fourth embodiment is configured as above. That is, except that the distal end of each of the ink supply tubes 12 is connected to the upper surface of the ink storage body 3, the fourth embodiment is the same as the first to third embodiments.

Figure 5:
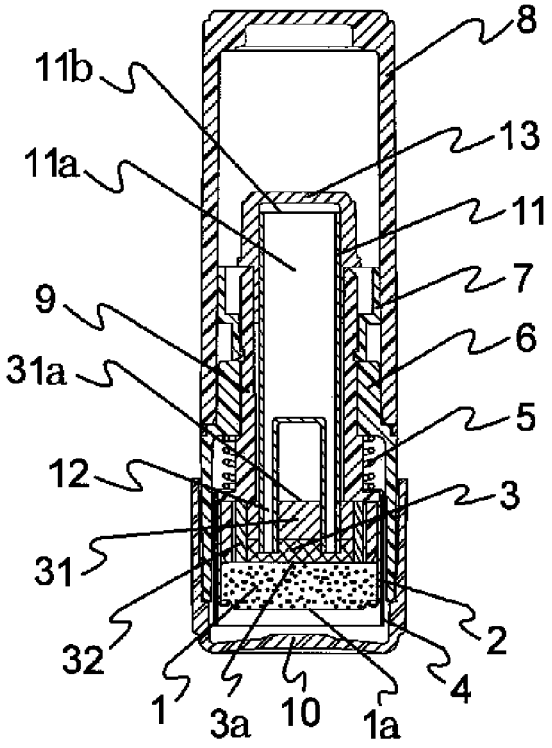
FIG. 5 is a schematic diagram illustrating a fifth embodiment of the present invention.
Figure 6:
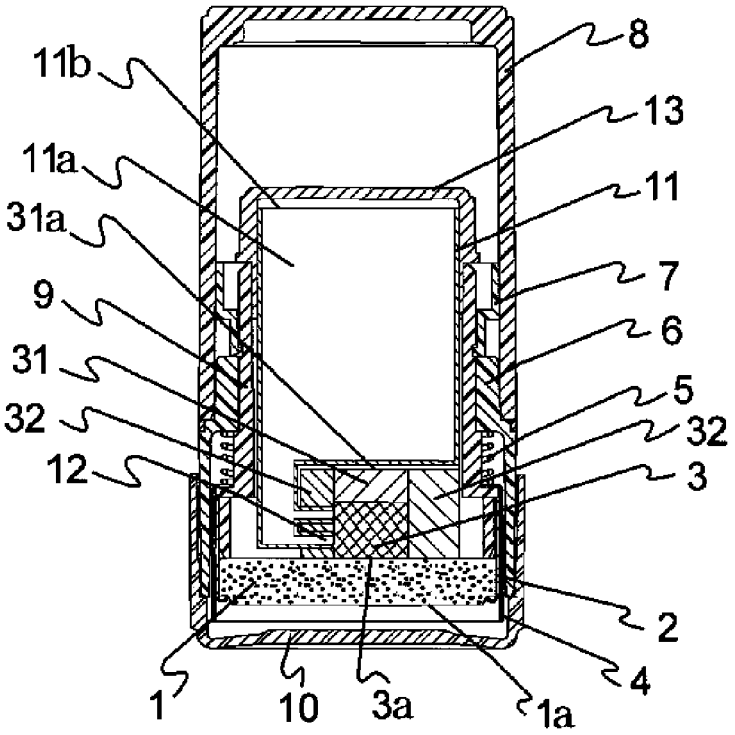
FIG. 6 is a schematic diagram illustrating a sixth embodiment of the present invention.

Next, based on FIG. 5, a self-inking stamp according to a fifth embodiment of the present invention will now be described in detail. The following description will be made only about a difference from the aforementioned embodiments.

In the fifth embodiment, the ink supply tubes 12 are disposed on the side of the upper surface of the ink storage body 2, in such a manner that the distal end of each of the ink supply tubes is connected to an inside of the ink storage body 3. As a method for the connection, it is conceivable to preliminarily provide a plurality of connection through-holes in the absorber 31 to extend downwardly from the upper surface of the absorber 31, and then insert the ink supply tubes 12 into the respective connection through-holes. Further, the ink supply tubes 12 are configured such that, as a result of the insertion, the distal end of each of the ink supply tubes 12 is inserted into a respective one of a plurality of connection holes preliminarily provided in the upper surface of the ink storage body 3, and thereby connected to the ink storage body 3.

As means to connect and join the ink supply tube 12 and the ink storage body 3 together in the fifth embodiment, it is conceivable to employ contact bonding, pressure bonding or adhesive bonding.

The term "contact bonding" means joining two members together in a contact manner. Examples of the contact bonding include inserting the ink supply tube 12 into a connection hole preliminarily provided in the ink storage body 3. In this case, the ink storage body 3 and the ink supply tube 12 are contact-bonded together by a frictional force between an inner peripheral surface of the connection hole of the ink storage body 3 and an outer peripheral surface of the ink supply tube 12.

The term "pressure bonding" means bringing two members into press-contact with each other. Examples of the pressure bonding include forcibly inserting the ink supply tube 12 into the ink storage body 3. In this case, the ink storage body 3 and the ink supply tube 12 are pressure-bonded together by a frictional force between a fiber bundle of the ink storage body and the outer peripheral surface of the ink supply tube 12.

The term "adhesive bonding" means joining two surfaces by a chemical force or the like using an adhesive as a medium. Examples of the adhesive bonding include applying an adhesive onto the outer peripheral surface of the ink supply tube 12, and then inserting the ink supply tube 12 into a connection hole preliminarily provided in the ink storage body 3 to thereby adhesively bond an inner peripheral surface of the connection hole and the outer peripheral surface of the ink supply tube 12 together by a chemical force. In this case, the open distal end of the ink supply tube 12 must not be closed up by the adhesive.

In the fifth embodiment, a plurality of connection through-holes are preliminarily provided in the absorber 31, and the ink supply tubes 12 are inserted into the respective connection through-holes, whereafter each of the ink supply tubes 12 is connected to a respective one of a plurality of connection holes preliminarily provided in the upper surface of the ink storage body 3, thereby establishing the connected state. In this case, the connected state between the ink storage body 3 and each of the ink supply tubes 12 is established by a frictional force between an outer peripheral surface of the ink supply tube 12 and an inner peripheral surface of a corresponding one of the connection holes of the ink storage body 3.

The self-inking stamp according to the fifth embodiment is configured as above. That is, except that the distal end of each of the ink supply tubes 12 is connected to the inside of the ink storage body 3, the fifth embodiment is the same as the fourth embodiment. In the fourth embodiment, the distal end of each of the ink supply tubes 12 is connected to the inside of the ink storage body 3, so that it becomes possible to provide stronger connection between each of the ink supply tubes 12 and the ink storage body 3.

Next, based on FIGS. 6 to 9, a self-inking stamp according to a sixth embodiment of the present invention will now be described in detail. The following description will be made only about a difference from the aforementioned embodiments.

In the sixth embodiment, the ink supply tubes 12 are disposed on the side of the outer lateral peripheral surface of the ink storage body 3, in such a manner that the distal end of each of the ink supply tubes 12 is connected to the outer lateral peripheral surface of the ink storage body 3. As a method for the connection, it is conceivable to preliminarily provide a plurality of connection through-holes in the wall member 32 to extend horizontally inwardly from an outer lateral peripheral surface of the wall member 32, and then insert the ink supply tubes 12 into the respective connection through-holes. The ink supply tubes 12 are configured such that, as a result of the insertion, the distal end of each of the ink supply tubes 12 is connected to the outer lateral peripheral surface of the ink storage body 3.

The self-inking stamp according to the sixth embodiment is configured as above. That is, except that the distal end of each of the ink supply tubes 12 is connected to the outer lateral peripheral surface of the ink storage body 3, the sixth embodiment is the same as the first to third embodiments.

Figure 7:
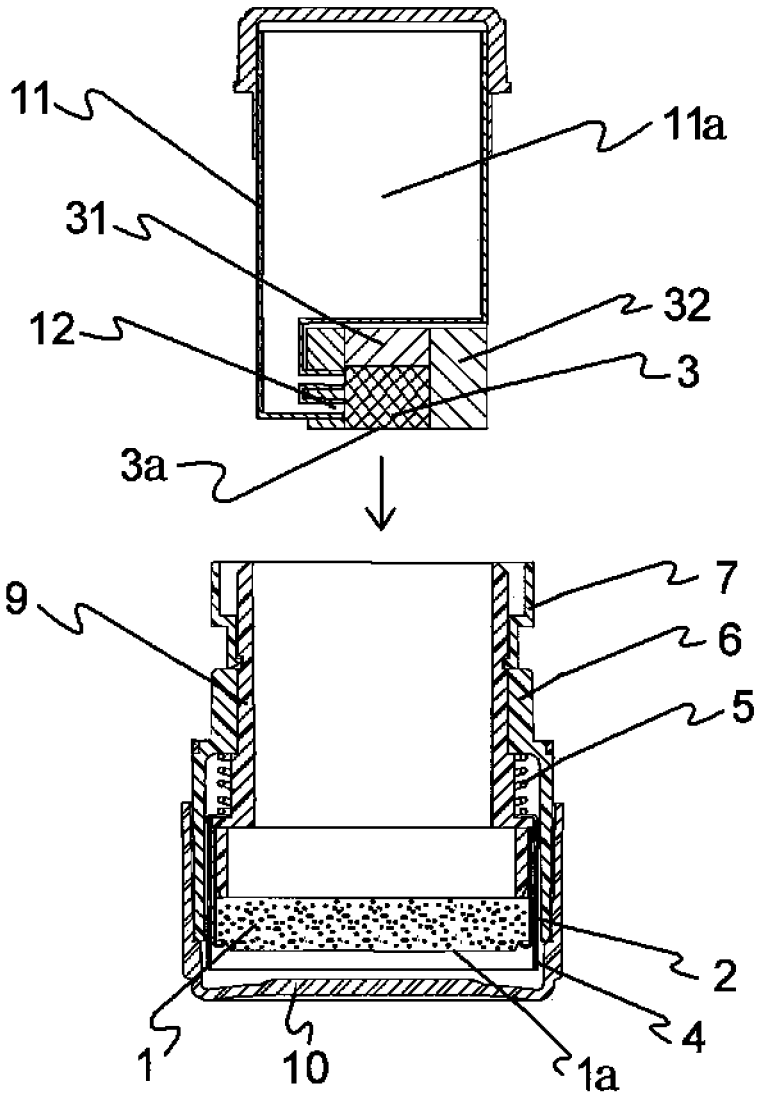
FIG. 7 is a schematic diagram illustrating an operation of attaching an ink tank, in the sixth embodiment.

As illustrated in FIG. 7, the self-inking stamp may be configured such that the ink storage body 3, the absorber 31 and the wall member 32 can be replaced to new ones in conjunction with the ink replenish operation of: detaching the grip body 8; extracting the ink tank 11 with the ink tank cap 13 fitted thereon; and replacing the extracted ink tank 11 with a new ink tank.

Figure 8:
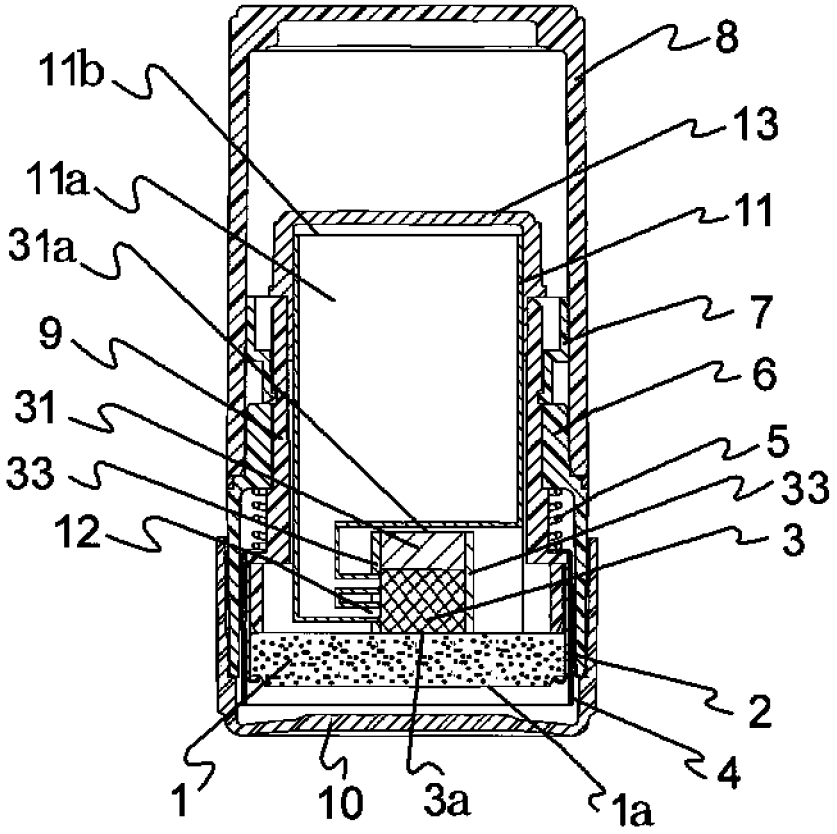
FIG. 8 is a schematic diagram illustrating another example of a wall member in the sixth embodiment.
Figure 9:
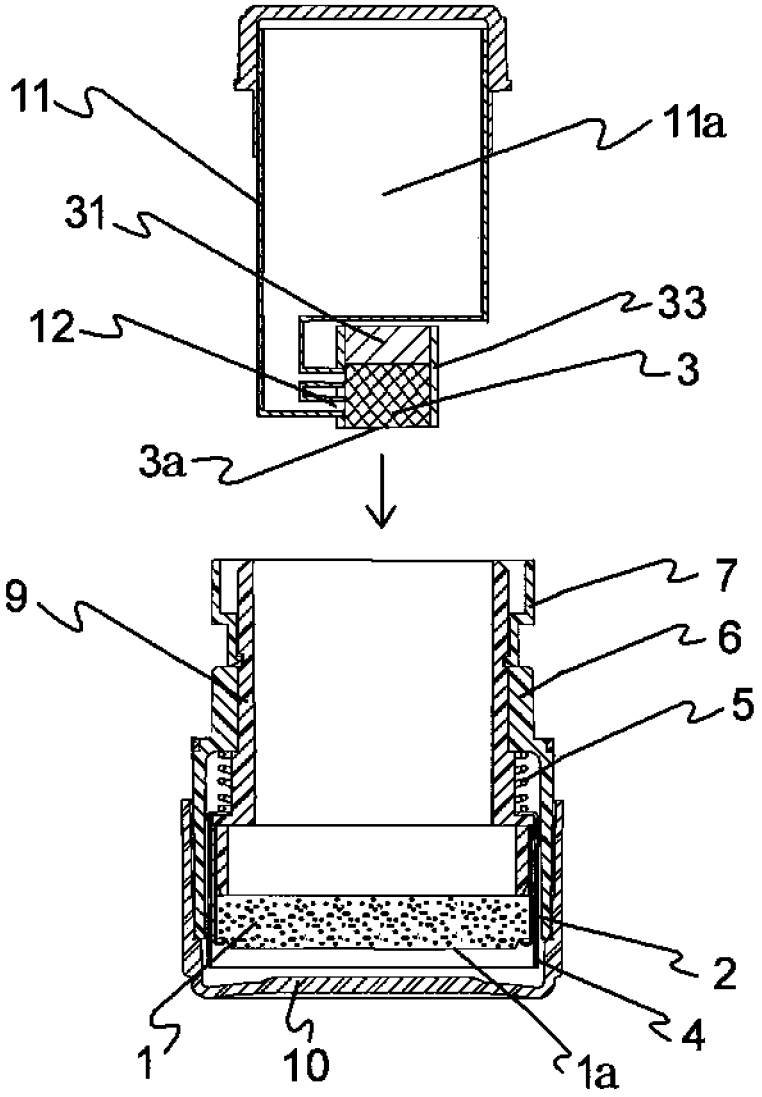
FIG. 9 is a schematic diagram illustrating the operation of attaching the ink tank, in another example of the wall member in the sixth embodiment.

An example of the sixth embodiment as a combination with the third embodiment is illustrated in FIGS. 8 and 9.

In this example, As the wall member covering respective outer lateral peripheral surfaces of the ink storage body 3 and the absorber 31, a barrier body 33 capable of blocking ink is employed. As a method for the connection of the ink supply tubes 12, it is conceivable to preliminarily provide a plurality of connection through-holes in the barrier wall 33 to extend horizontally inwardly from an outer lateral peripheral surface of the barrier wall 33, and then insert the ink supply tubes 12 into the respective connection through-holes. The ink supply tubes 12 are configured such that, as a result of the insertion, the distal end of each of the ink supply tubes 12 is connected to the outer lateral peripheral surface of the ink storage body 3. In this case, it is possible to detachably and fittingly attach the ink supply tubes 12 to the barrier body 33. Alternatively, the barrier body 33 may be integrally formed together with the ink supply tubes 12.

Figure 10:
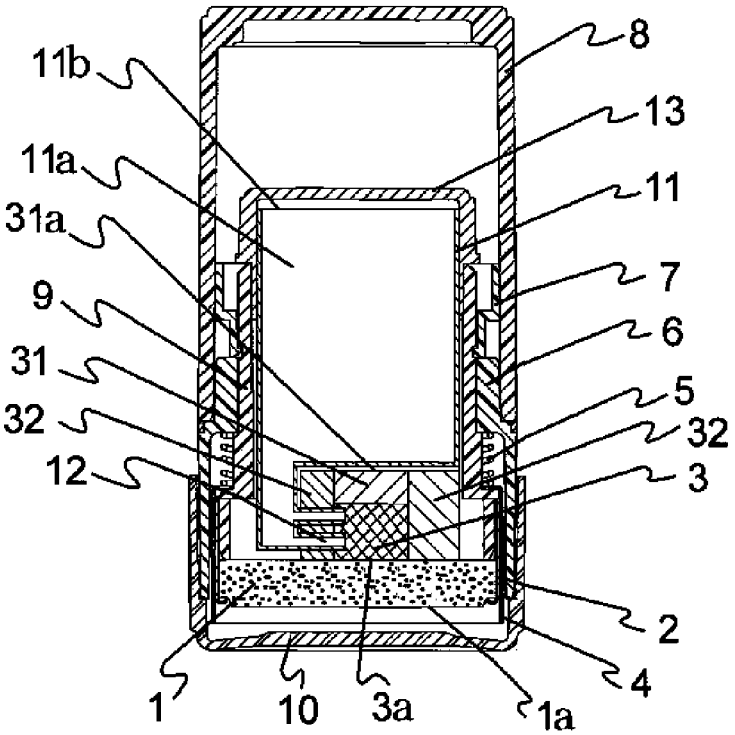
FIG. 10 is a schematic diagram illustrating a seventh embodiment of the present invention.
Figure 11:
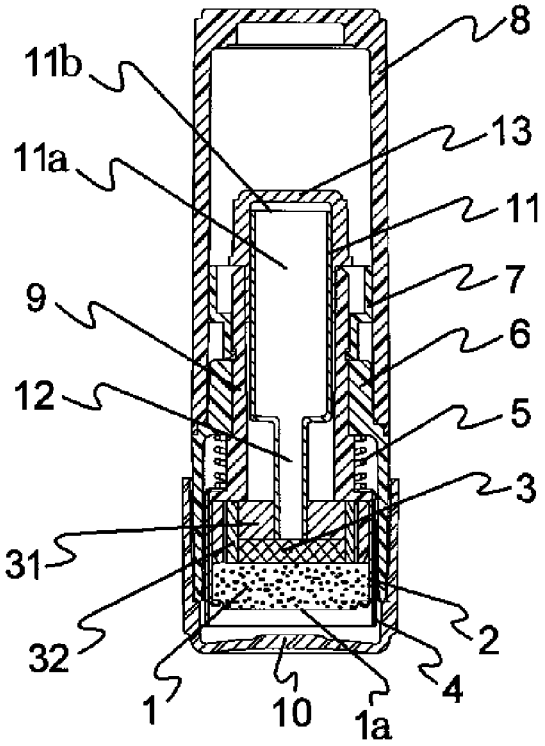
FIG. 11 is a schematic diagram illustrating an eighth embodiment of the present invention.
Figure 12:
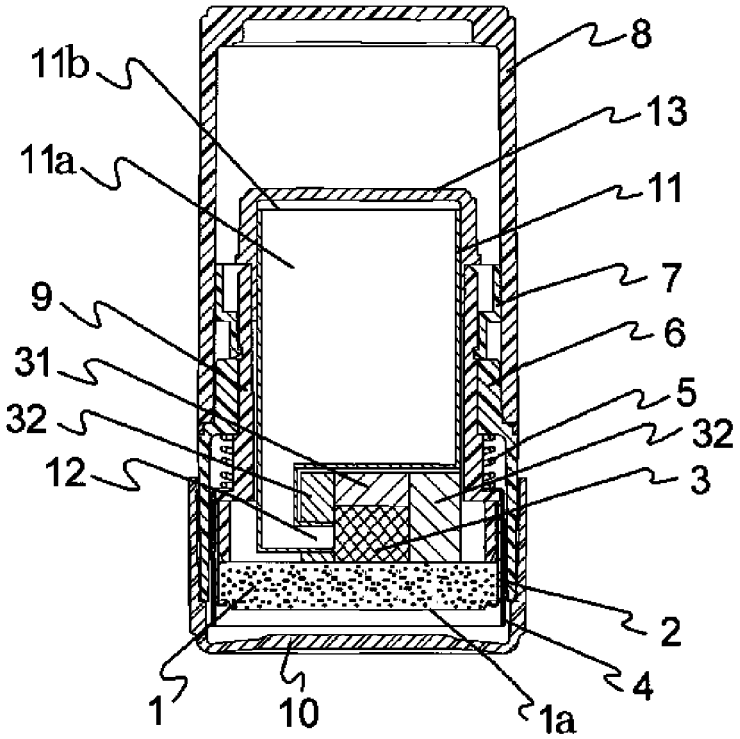
FIG. 12 is a schematic diagram illustrating another example of an ink supply tube in the eighth embodiment.

Next, based on FIG. 10, a self-inking stamp according to a seventh embodiment of the present invention will now be described in detail. The following description will be made only about a difference from the aforementioned embodiments.

In the seventh embodiment, the ink supply tubes 12 are disposed on the side of the outer lateral peripheral surface of the ink storage body 3, in such a manner that the distal end of each of the ink supply tubes 12 is connected to the inside of the ink storage body 3. As a method for the connection, it is conceivable to preliminarily provide a plurality of connection through-holes in the wall member 32 to extend horizontally inwardly from an outer lateral peripheral surface of the wall member 32, and then insert the ink supply tubes 12 into the respective connection through-holes. Further, the ink supply tubes 12 are configured such that, as a result of the insertion, the distal end of each of the ink supply tubes 12 is inserted into a respective one of a plurality of connection holes preliminarily provided in the outer lateral peripheral surface of the ink storage body 3, and thereby connected to the ink storage body 3.

A method of connecting and joining each of the ink supply tubes 12 and the ink storage body 3 together in the seventh embodiment is the same as that in the fifth embodiment.

The self-inking stamp according to the seventh embodiment is configured as above. That is, except that the distal end of each of the ink supply tubes 12 is connected to the inside of the ink storage body 3, the seventh embodiment is the same as the sixth embodiment. In the seventh embodiment, the distal end of each of the ink supply tubes 12 is connected to the inside of the ink storage body 3, so that it becomes possible to provide stronger connection between each of the ink supply tubes 12 and the ink storage body 3.

Next, based on FIGS. 11 to 15, a self-inking stamp according to an eighth embodiment of the present invention will now be described in detail. The following description will be made only about a difference from the aforementioned embodiments.

In the eighth embodiment, the number of the ink supply tubes 12 is set to one. As mentioned above, a cross-sectional shape of an outer or inner peripheral surface of the ink supply tube 12 may be a circular shape, an elliptical shape or a polygonal shape such as a triangular shape or a quadrangular shape. The distal end of the ink supply tube 12 may be opened downwardly in an up-down direction, or may be opened radially outwardly. Examples of a shape of the distal end of the ink supply tube 12 include an obliquely cut surface, a vertical surface, a conical surface and a convexedly curved surface.

In the eighth embodiment, a shape of the ink supply tube 12 is selected to allow the one ink supply tube 12 to perform both of the function of supplying ink contained in the ink tank 11, into the ink storage body 3 and the function of supplying external air into the ink tank 11.

The self-inking stamp according to the eighth embodiment is configured as above. Functions of this self-inking stamp will be described in detail below.

Except that both of the function of supplying ink contained in the ink tank 11, into the ink storage body 3 and the function of supplying external air into the ink tank 11 are performed by the one ink supply tube 12, the eighth embodiment is the same as the aforementioned embodiments.

Figure 13:
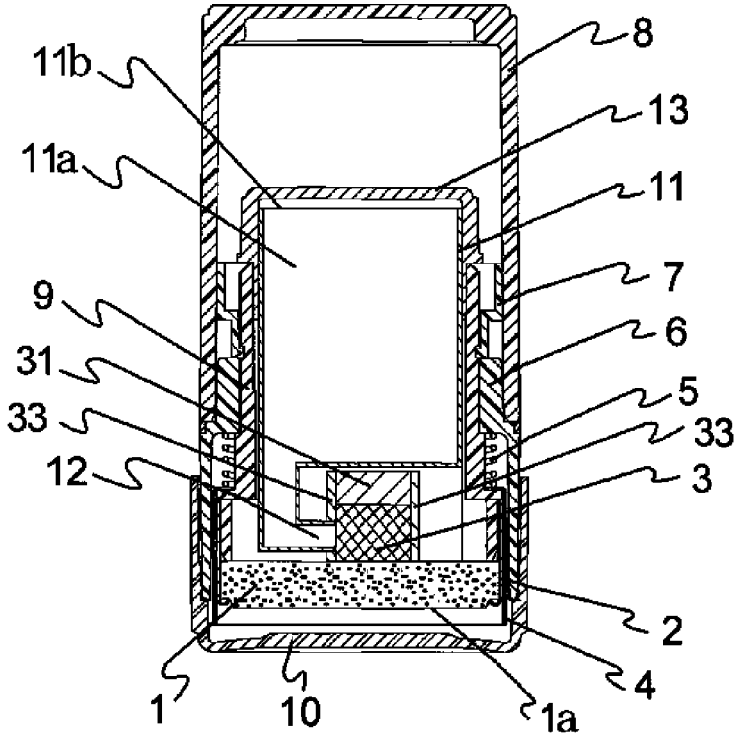
FIG. 13 is a schematic diagram illustrating another example of a wall member in the eighth embodiment.

An example of the eighth embodiment as a combination with the third embodiment is illustrated in FIG. 13. In this example, as the wall member covering respective outer lateral peripheral surfaces of the ink storage body 3 and the absorber 31, a barrier body 33 capable of blocking ink is employed. As a method for the connection of the ink supply tubes 12, it is conceivable to preliminarily provide a connection through-hole in the barrier wall 33 to extend horizontally inwardly from an outer lateral peripheral surface of the barrier wall 33, and then insert the ink supply tube 12 into the connection through-hole. The ink supply tube 12 is configured such that, as a result of the insertion, the distal end of the ink supply tube 12 is connected to the outer lateral peripheral surface of the ink storage body 3. In this case, it is possible to detachably and fittingly attach the ink supply tube 12 to the barrier body 33. Alternatively, the barrier body 33 may be integrally formed together with the ink supply tube 12.

Figure 14:
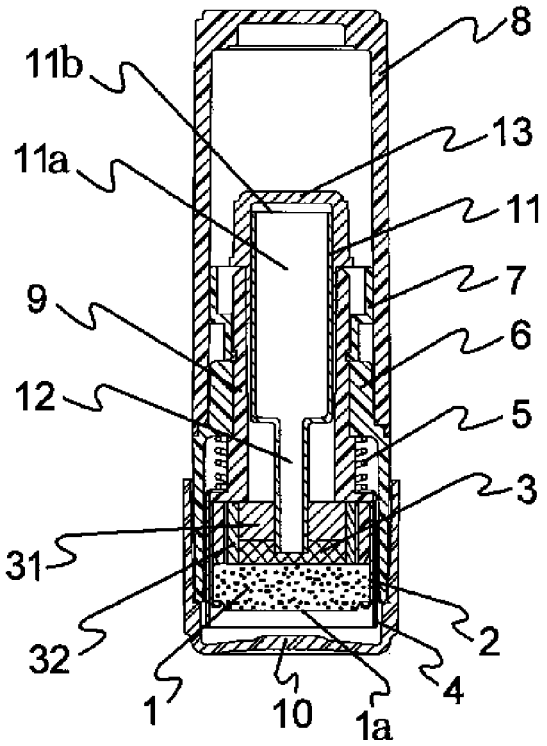
FIG. 14 is a schematic diagram illustrating another example of a connection method in the eighth embodiment.
Figure 15:
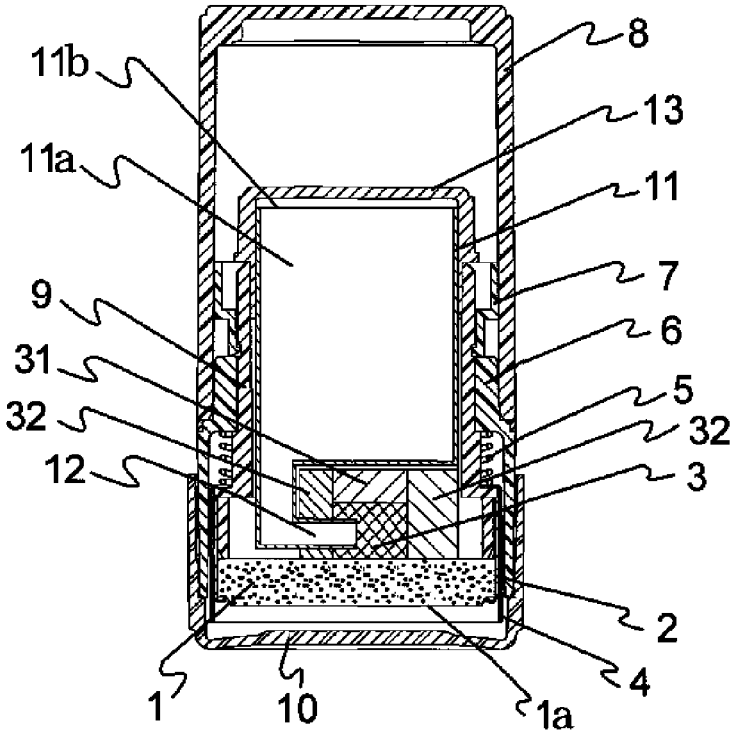
FIG. 15 is a schematic diagram illustrating yet another example of the connection method in the eighth embodiment.

Other examples of the eighth embodiment as a combination with the fifth and seventh embodiments are illustrated in FIGS. 14 and 15. In this example, the distal end of the ink supply tube 12 is connected to the inside of the ink storage body 3, so that it becomes possible to provide stronger connection between the ink supply tube 12 and the ink storage body 3.

Figure 16:
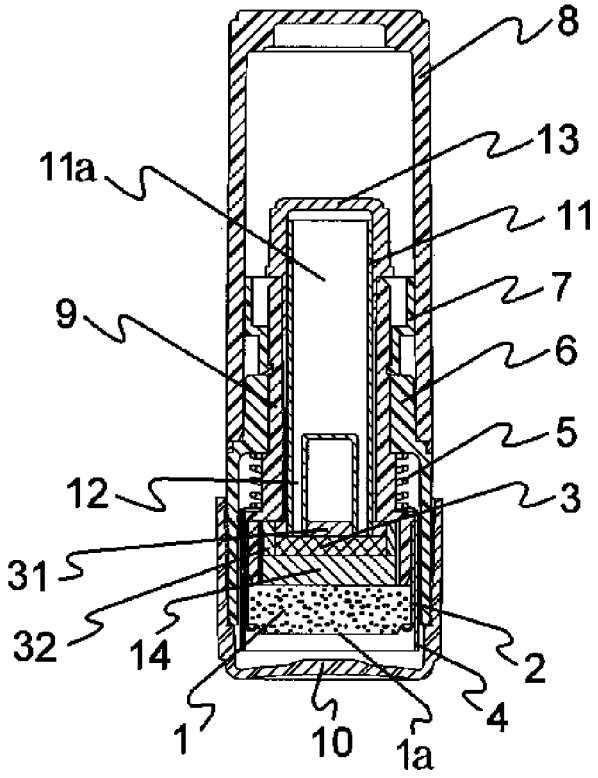
FIG. 16 is a schematic diagram illustrating an adjustor body employed in the first embodiment.

In the aforementioned embodiments, an adjuster body 14 may be disposed between the porous marking block 1 and the ink storage body 3, to adjust a flow rate of ink with respect to the porous marking block 1, as illustrated in FIG. 16. Preferably, the adjuster body 14 is composed of a sintered body of a synthetic resin powder, having a sponge structure with appropriate hardness, such as polyvinyl acetal-based resin. In this case, the adjuster body 14 is capable of supplying an appropriate amount of ink to the porous marking block 1, so that it is useful for preventing stickiness of a marked impression. A relationship in terms of capillary force between respective ones of the porous marking block 1, the ink storage body 3 and the adjuster body 14 may be adjusted to allow an appropriate amount of ink to be moved to the marking surface 1*a*.

In the case where ink used has a relatively low viscosity, a capillary force of the adjuster body 14 is set to be greater than that of the porous marking block 1 to thereby increase an ink retention force. On the other hand, in the case where ink used has a relatively high viscosity, the capillary force of the adjuster body 14 is set to be less than that of the porous marking block 1 to thereby reduce the ink retention force. In this way, the movement of ink toward the porous marking block 1 may be adjusted.

Next, based on FIG. 17, a self-inking stamp according to a ninth embodiment of the present invention will now be described in detail. The following description will be made only about a difference from the aforementioned embodiments.

Figure 17:
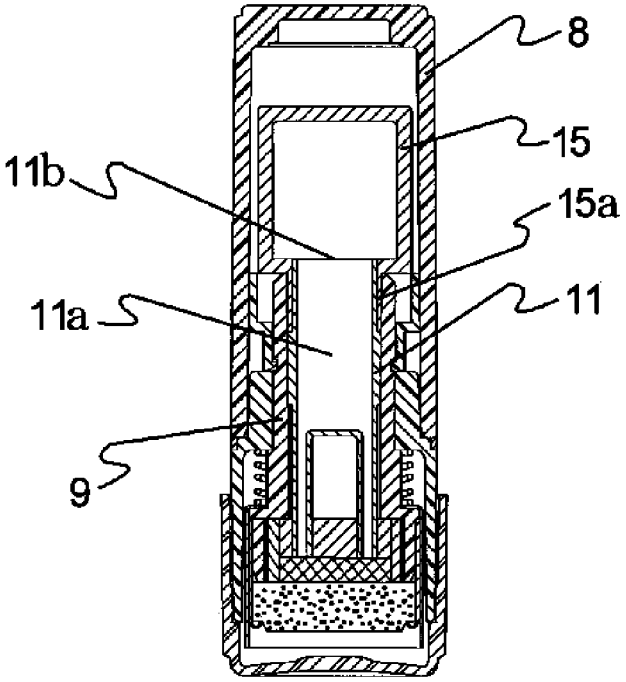
FIG. 17 is a schematic diagram illustrating a ninth embodiment of the present invention.

As illustrated in FIG. 17, the self-inking stamp according to the ninth embodiment comprises a replaceable ink cartridge 15 containing ink, in place of the ink tank cap 13, wherein the replaceable ink cartridge 15 is detachably and fittingly attached to the opening portion 11*b*. The replaceable ink cartridge 15 is composed of a bottomed tubular body having one end formed as an open end 15*a* which is configured to be detachably and fittingly attached to the opening portion 11*b*. Thus, as with the aforementioned embodiments, the opening portion 11*b* is hermetically sealed with respect to the outside by the open end 15*a* of the replaceable ink cartridge 15. As a result of the hermetical sealing, it becomes possible to prevent ink contained in the replaceable ink cartridge 15 from leaking to the outside. In this embodiment, a position where the opening portion 11*b* and the open end 15*a* are fittingly attached to each other may be identical to or may be different from a position for the hermetical sealing. As a fitting method for the fitting attachment, it is possible to employ various techniques, such as concave-convex fitting, press-fitting and screw fitting.

In this embodiment, in order to prevent the ink tank 11 from being disengaged from the stamp casing 9 during an operation of detaching the replaceable ink cartridge 15 from the ink tank 11, it is necessary that a fitting force between the ink tank 11 and the replaceable ink cartridge 15 is set to be less than a fitting force between the ink tank 11 and the stamp casing 9.

Further, before use, a cap (not illustrated) is fitted onto the open end 15*a*. Then, in use, after detaching the cap, the open end 15*a* is fittingly attached to the opening portion 11*b*. During this operation, in order to prevent leakage of ink from the replaceable ink cartridge 15, the open end 15*a* is fittingly attached to the opening portion 11*b*, while being maintained in a posture where an edge face of the open end 15*a* is oriented upwardly with respect to the ground.

The self-inking stamp according to the ninth embodiment is configured as above. Functions of this self-inking stamp will be described in detail below.

When the replaceable ink cartridge 15 is replaced with a new one because ink contained therein is fully consumed, the replaceable ink cartridge 15 is detached from the ink tank 11. During the detachment, the ink tank 11 is maintained in a state in which it is fitted in the stamp casing 9. Then, a new replaceable ink cartridge 15 is attached to the opening portion 11*b* of the ink tank 11, in a posture where the open end 15*a* serves as a leading end.

In the operation of attaching a new replaceable ink cartridge 15, after detaching a cap (not illustrated) from an open end 15*a* of the replaceable ink cartridge 15, the open end 15*a* is fittingly attached to the opening portion 11*b* of the ink tank 11, while being maintained in a posture where an edge face of the open end 15*a* is oriented upwardly with respect to the ground, so as to prevent leakage of ink from the replaceable ink cartridge 15.

Next, based on FIGS. 18 to 20, a self-inking stamp according to a tenth embodiment of the present invention will now be described in detail. The following description will be made only about a difference from the aforementioned embodiments.

Figure 18:
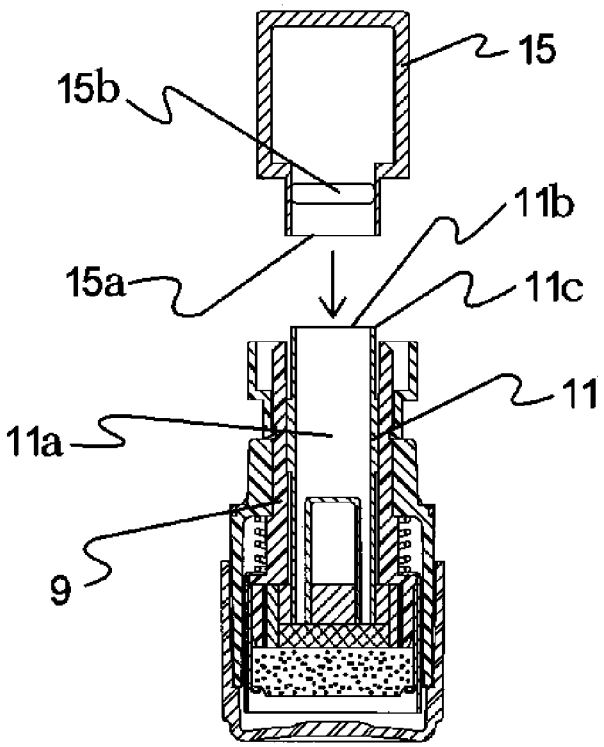
FIG. 18 is a schematic diagram illustrating an operation of attaching a replaceable ink cartridge, in a tenth embodiment of the present invention.
Figure 19:
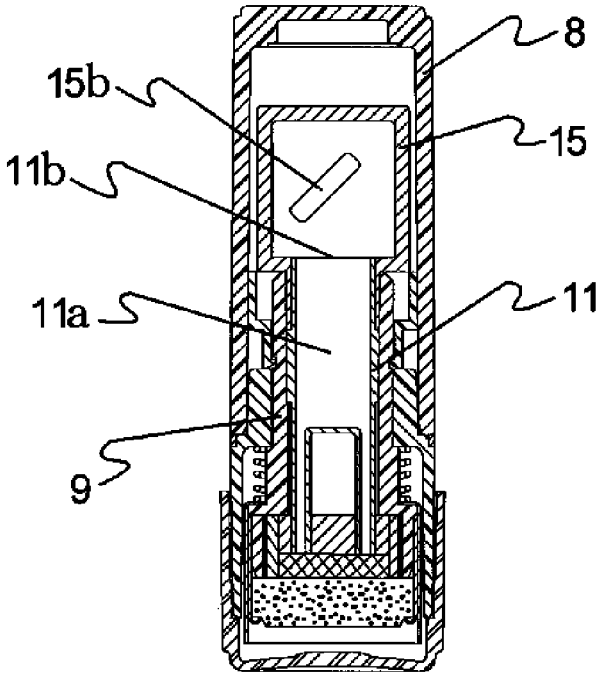
FIG. 19 is a schematic diagram illustrating the tenth embodiment.
Figure 20:
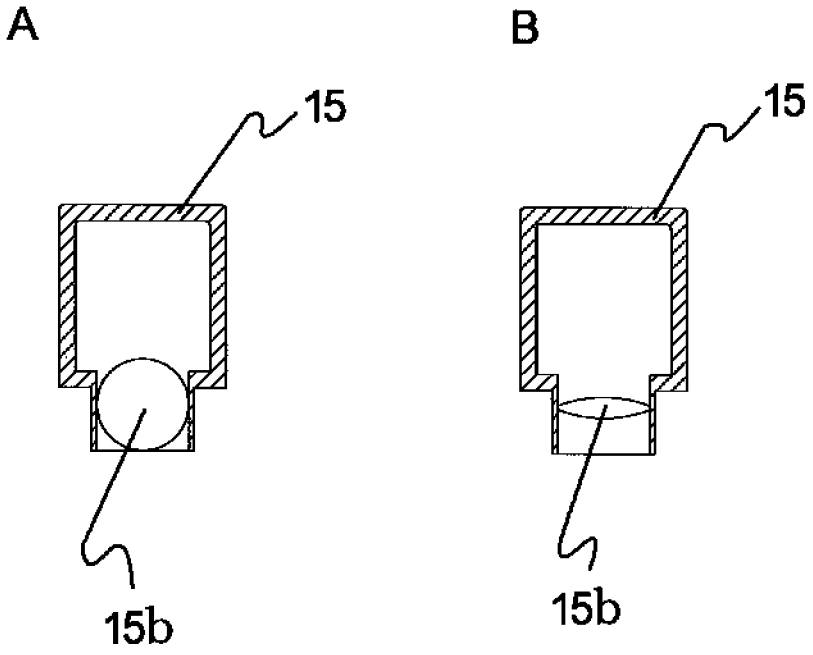
FIG. 20 is a schematic diagram illustrating other examples of the replaceable ink cartridge, in the tenth and aftermentioned nineteenth embodiments.

As illustrated in FIGS. 18 to 20, the self-inking stamp according to the tenth embodiment comprises a plate-shaped plug member 15*b* installed in the open end 15*a*, in addition to the components in the ninth embodiment.

The plug member 15*b* is installed in the open end 15*a* of the replaceable ink cartridge 15 in such a manner as to close the open end 15*a* until the replaceable ink cartridge 15 is attached to the ink tank 11. Then, when the replaceable ink cartridge 15 is attached to the ink tank 11, the plug member 15*b* is pushed toward an inside of the opening portion 11*b* by a plug-member pushing member 11*c* provided in the opening portion 11*b* of the ink tank 11, and opened. In the tenth embodiment, as with the aforementioned embodiments, the opening portion 11*b* is hermetically sealed with respect to the outside by the open end 15*a* of the replaceable ink cartridge 15.

In order to prevent unexpected ink leakage, it is desirable that the plug member 15*b* is opened when, with respect to a position where a hermetically sealed state between the open end of the replaceable ink cartridge and the opening portion of the ink tank is established, the open end of the replaceable ink cartridge is slightly displaced while maintaining the hermetically sealed state. The plug-member pushing member 11*c* may be formed by utilizing an edge face of opening portion 11*b* without any modification, or may be formed by providing an additional protrusion.

As the plug member 15*b*, it is possible to select one of various types, such as a spherical-shaped member (FIG. 20A) and a lens-shaped member (FIG. 20B). Alternatively, the plug member 15*b* may be formed of a material, such as a film (not illustrated), breakable by the plug-member pushing member 11*c*.

The self-inking stamp according to the tenth embodiment is configured as above. Functions of this self-inking stamp will be described in detail below.

In the tenth embodiment where the plug member 15*b* is installed in the open end 15*a* of the replaceable ink cartridge 15, the plug member 15*b* is opened when being pushed by the plug-member pushing member 11*c* toward the inside of the replaceable ink cartridge 15. Thus, in the tenth embodiment, there is no risk of outflow of ink until the plug member is opened. Thus, it is not necessary to maintain the open end 15*a* in a posture where an edge face of the open end 15*a* is oriented upwardly with respect to the ground, as in the ninth embodiment. That is, the open end 15*a* can be attached, irrespective of whether the edge face of the open end 15*a* is oriented upwardly, downwardly or laterally. When the plug member 15*b* is formed of a breakable material such as a film, it will be broken by the plug-member pushing member 11*c* and opened.

Next, based on FIGS. 21 and 22, a self-inking stamp according to an eleventh embodiment of the present invention will now be described in detail. The following description will be made only about a difference from the aforementioned embodiments.

Figure 21:
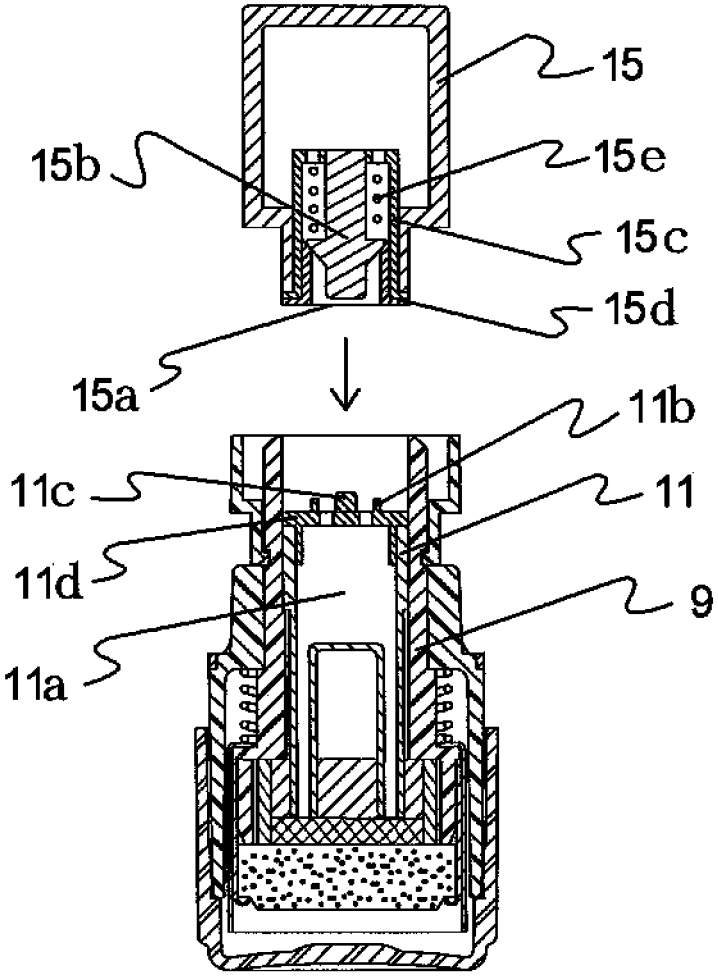
FIG. 21 is a schematic diagram illustrating an operation of attaching a replaceable ink cartridge, in an eleventh embodiment of the present invention.
Figure 22:
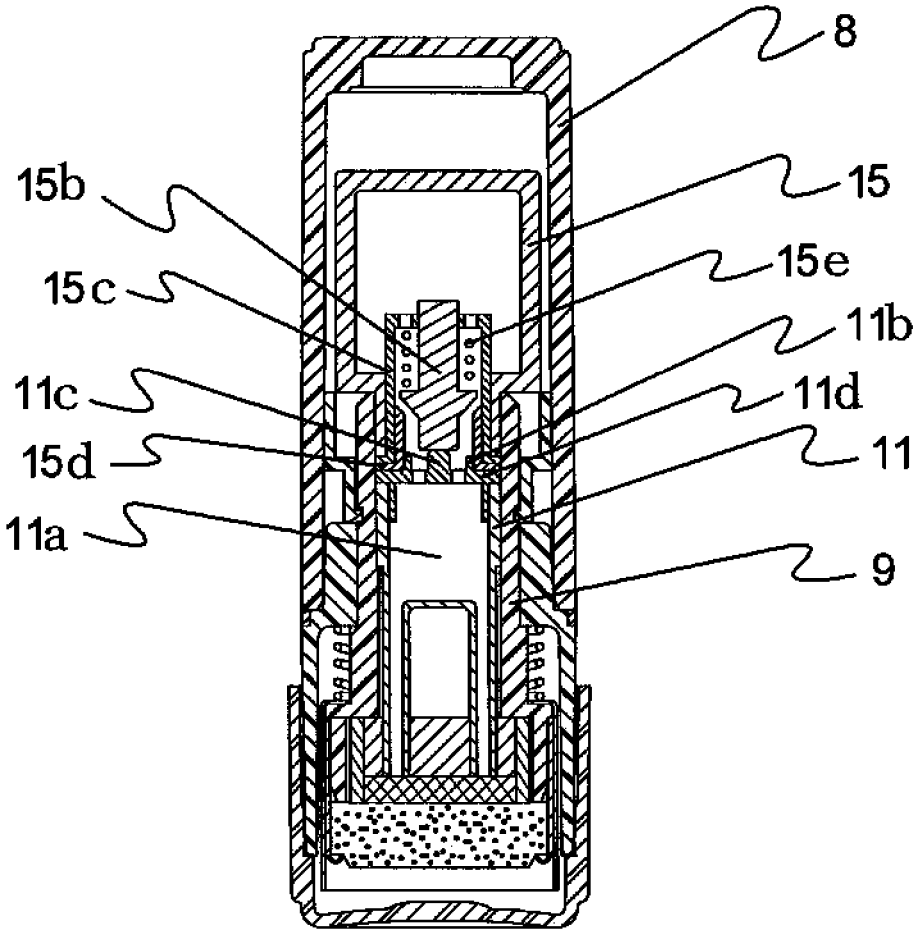
FIG. 22 is a schematic diagram illustrating the eleventh embodiment.

As illustrated in FIGS. 21 and 22, the self-inking stamp according to the eleventh embodiment comprises a valve device installed in the open end 15*a* of the replaceable ink cartridge 15 and configured such that an aftermentioned plug member 15*b* is opened when being pushed by the plug-member pushing member 11*c*, and closed when being separated from the plug-member pushing member 11*c*, in addition to the components in the ninth embodiment.

The valve device comprises a tubular valve casing 15*c*, a cap member 15*d*, a plug member 15*b*, and a coil spring 15*e*. In a state in which the plug member 15*b* is installed inside the tubular valve casing 15*c* through the coil spring 15*e*, the cap member 15*d* is fitted in an opening portion of the tubular valve casing 15*c*. An inner periphery of an ink outlet hole provided in the cap member 15*d* is formed as a valve seat portion engageable with a valve element provided on the plug member 15*b*. In the separated state, the valve element of the plug member 15*b* is pressed against the valve seat portion of the cap member 15*d* in a close contact manner by a spring force of the coil spring 15*e*.

When the plug member 15*b* is pushed upwardly by the plug-member pushing member 11*c*, the plug member 15*b* is moved upwardly against the spring force of the coil spring 15*e*, so that the close contact state between the valve element and the valve seat portion is released, and thereby ink contained in the replaceable ink cartridge 15 flows into the ink tank 11. Then, when the pushing by the plug-member pushing member 11*c* is released, the valve element is pressed against and brought into close contact with the valve seat portion of the cap member 15*d* again by the spring force of the coil spring 15*e*, so that the plug member 15*b* is closed.

The plug-member pushing member 11*c* may be integrally provided together with the ink tank 11, or may be provided as a separate component, as illustrated in FIGS. 21 and 22. When the plug-member pushing member 11*c* is provided as a separate component, an inner cap 11*d* is attached to the opening portion 11*b* of the ink tank 11, wherein the plug-member pushing member 11*c* is provided on an upper wall of the inner cap 11*d*, and the opening portion 11*b* is provided in the upper wall of the inner cap 11*d* at a position around the plug-member pushing member 11*c*. Then, the open end 15*a* of the replaceable ink cartridge 15 is detachably and fittingly attached to the opening portion 11*b* of the ink tank 11. As with the aforementioned embodiments, the opening portion 11*b* is hermetically sealed with respect to the outside by the open end 15*a* of the replaceable ink cartridge 15.

The self-inking stamp according to the eleventh embodiment is configured as above. Functions of this self-inking stamp will be described in detail below.

In the valve device configured such that the plug member 15*b* is opened when being pushed by the plug pushing member 11*c*, the open end 15*a* can be attached without any restriction on orientation of the edge face thereof. That is, the open end 15*a* can be attached, irrespective of whether the edge face of the open end 15*a* is oriented upwardly, downwardly or laterally.

In an operation of detaching an old replaceable ink cartridge 15 from the ink tank 11 so as to be replaced with a new replaceable ink cartridge 15, when ink remains in the old replaceable ink cartridge 15, the remaining ink is likely to leak to the outside. However, in the self-inking stamp using the valve device, even when an old replaceable ink cartridge 15 is detached from the ink tank 11, the open end 15*a* is closed by the action of the valve device, so that it becomes possible to prevent ink leakage.

Although the ninth to eleventh embodiments have been described based on the configuration in the fourth embodiment, it is to be understood that the ninth to eleventh embodiments may be implemented in each of the fifth to eighth embodiments.

Figure 23:
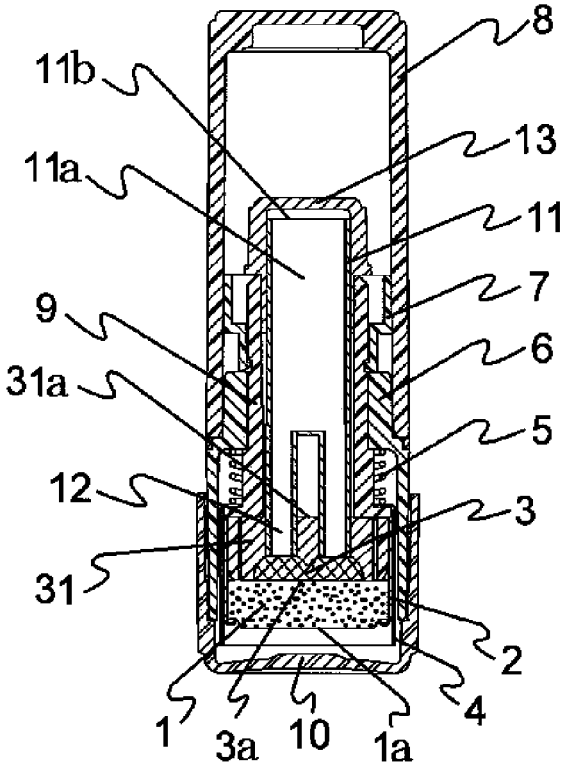
FIG. 23 is a schematic diagram illustrating twelfth and thirteenth embodiments of the present invention.

Next, based on FIG. 23, a self-inking stamp according to a twelfth embodiment of the present invention will now be described in detail. The following description will be made only about a difference from the aforementioned embodiments.

A primitive absorber 31' is placed on the upper surface of the porous marking block 1.

Then, the ink storage body 3 and the absorber 31 are formed from the primitive absorber 31'. That is, the ink storage body 3 and the absorber 31 are formed from a primitive absorber 31' which is a single body prepared using the same material.

A method for the formation comprises pressingly inserting the distal ends of the ink supply tubes 12 into the single body from the side of an upper surface thereof, so that a region of the single body around the distal ends of the ink supply tubes 12 is formed as the ink storage body 3. In this way, the ink storage body 3 is formed in the single body, wherein the absorber 31 configured to generate a capillary force less than that of the ink storage body 3 and absorb excess ink from the ink storage body 3 is formed around an upper and outer lateral peripheral surfaces of the ink storage body 3. The wall member covering the outer lateral peripheral surface of the ink storage body 3 to prevent ink leakage is formed by the absorber 31.

The single body may be any type having a capillary space. Examples thereof include a resin-processed body of a fiber bundle, a fusion-bonded body of a fiber bundle, a felted body, a needlepunched body of felt, a porous material such as porous synthetic resin foam, and a synthetic resin extrusion-molded body having an axial ink guidepath. As a material therefor, it is possible to use a synthetic resin fiber, such as acrylic fiber or polyester fiber.

As used herein, the term "capillary force" means a force causing capillary rise, and a force causing ink to move through the capillary space. Thus, the configuration in which a capillary force of the absorber 31 is less than that of the ink storage body 3 means that ink is less likely to be moved to the absorber 31.

The absorber 31 is also configured such that a part or an entirety of an outer surface thereof is provided with an air passage opening 31*a* opened to communicate with atmospheric air, to thereby allow a replacement of outflow ink by external air to be performed.

A part or an entirety of a lower surface of the ink storage body 3 is opened to form an ink outlet opening 3*a*. The ink storage body 3 is formed to be placed on the upper surface of the porous marking block 1. The ink outlet opening 3*a* is in contact with the upper surface of the porous marking block 1. A relationship in terms of capillary force between the porous marking block 1 and the ink storage body 3 is adjusted to allow an appropriate amount of ink to be moved to the marking surface 1*a*.

The self-inking stamp may further comprise an outer skin composed of a synthetic resin film or the like and formed on an outer peripheral surface of the absorber 31.

The stamp according to the twelfth embodiment is assembled in the following manner. First of all, as illustrated in FIG. 23, the porous marking block 1 with the single body placed on the upper surface thereof is fittingly mounted to and held by the bracket 2, and, in this state, the bracket 2 is fittingly attached to the lower end of the stamp casing 9. Then, the slide 4, the spring 5, the sheath 6 and the fixing ring 7 are inserted from the side of the open upper end of the stamp casing 9, and the sheath 6 is fixed to the stamp casing 9 by the fixing ring 7. Subsequently, the ink tank 11 is inserted into the open upper end of the stamp casing 9 and fitted in the stamp casing 9.

As a result of the insertion of the ink tank 11, the distal ends of the ink supply tubes 12 are pressingly inserted into the single body to form the ink storage body 3 around the distal ends of the ink supply tubes 12, so that the distal ends of the ink supply tubes 12 are connected to the ink storage body 3. A direction along which the distal ends of the ink supply tubes 12 are pressingly inserted into the single body may be a downward direction with respect to the upper surface of the single body, or may be a horizontally inward direction with respect to the outer lateral peripheral surface of the single body. Then, the grip body 8 is fitted onto the sheath 6 and the fixing ring 7, and the marking surface cap 10 is fittingly attached to the lower end of the sheath 6.

As used in the twelfth embodiment, the term "connect" means joining the ink supply tube 12 and the ink storage body 3 together. As means to connect and join the ink supply tube 12 and the ink storage body 3 together in the twelfth embodiment, it is conceivable to employ pressure bonding as mentioned above. The pressure bonding means bringing two members into press-contact with each other. Examples of the pressure bonding include forcibly inserting the ink supply tube 12 into the single body. In this case, the ink storage body 3 and the ink supply tube 12 are pressure-bonded together by a pressing force of the distal end of the ink supply tube 12.

The self-inking stamp according to twelfth embodiment is configured as above. Functions of this self-inking stamp will be described below.

The ink supply tubes 12 have a function of supplying ink contained in the ink tank 11, into the ink storage body 3, and a function of supplying external air into the ink tank 11. When the marking surface 1*a* is oriented downwardly, ink contained in the ink tank 11 is gravitationally supplied to the ink storage body 3 via at least one of the ink supply tubes 12, i.e., the function of supplying ink from the ink tank 11 into the ink storage body 3 is activated. Concurrently, external air is introduced into the ink tank 11 via a remaining at least one of the ink supply tubes 12. Thus, ink contained in the ink tank 11 will be gradually infiltrated in the ink storage body 3. The supply of ink will continue until a level of ink infiltrated in the ink storage body 3 reaches the open distal end of the remaining ink supply tube 12 which is introducing external air therethrough.

When the level of ink infiltrated in the ink storage body 3 reaches the open distal end of the remaining ink supply tube 12 which is introducing external air therethrough, the open distal end is airtightly closed, so that a supply of external air into the ink tank 11 is stopped. Then, a supply of ink from the ink tank 11 to the ink storage body 3 via the ink supply tube 12 is also stopped.

In this way, outflow of ink from the ink tank 11 and inflow of air into the ink tank 11 (i.e., replacement between ink and air) are stopped, and the ink tank is temporarily maintained in a hermetically sealed state.

When a marking operation is continuously performed in this state, ink is supplied from the ink outlet opening 3*a* provided in the ink storage body 3 to the porous marking block 1, by an amount corresponding to consumption of ink in the porous marking block 1. Then, when ink infiltrated in the ink storage body 3 is reduced, the hermetically sealed state is released, and ink is supplied from the ink tank 11 to the ink storage body 3 via the ink supply tube 12 by an amount corresponding to the ink supplied from the ink storage body 3 to the porous marking block 1. Thus, the marking operation can be performed until ink contained in the ink tank 11 is fully consumed.

When an external temperature changes in a situation where the ink tank 11 is in the hermetically sealed state, an internal pressure of the ink tank is changed. For example, when the external temperature rises as compared to that at the time the ink tank 11 comes into the hermetically sealed state, the internal pressure of the ink tank becomes higher due to expansion of air within the ink tank, and thereby ink is discharged from the ink supply tubes 12. The discharged ink is absorbed by the absorber 31 provided with the air passage opening 31*a* communicating with atmospheric air, or absorbed or blocked by the wall member 32, thereby being kept from moving toward the porous marking block 1. In this state, when the external temperature falls down, the internal temperature of the ink tank becomes lower, and thereby the previously discharged ink is sucked back into the ink tank via the ink supply tubes 12.

On the other hand, when the external temperature falls down as compared to that at the time the ink tank comes into the hermetically sealed state, the internal pressure of the ink tank becomes lower due to contraction of air within the ink tank, and thereby ink located around the open distal ends of the ink supply tubes 12 is sucked into the ink tank via the ink supply tubes 12. In this state, when the external temperature rises, the internal temperature of the ink tank becomes higher, and thereby the previously sucked ink is discharged from the ink supply tubes 12.

In an ink replenishment operation, the grip body 8 is first detached, and the ink tank 11 with the ink tank cap 13 fitted thereon is extracted and replaced with a new ink tank 11.

Figure 24:
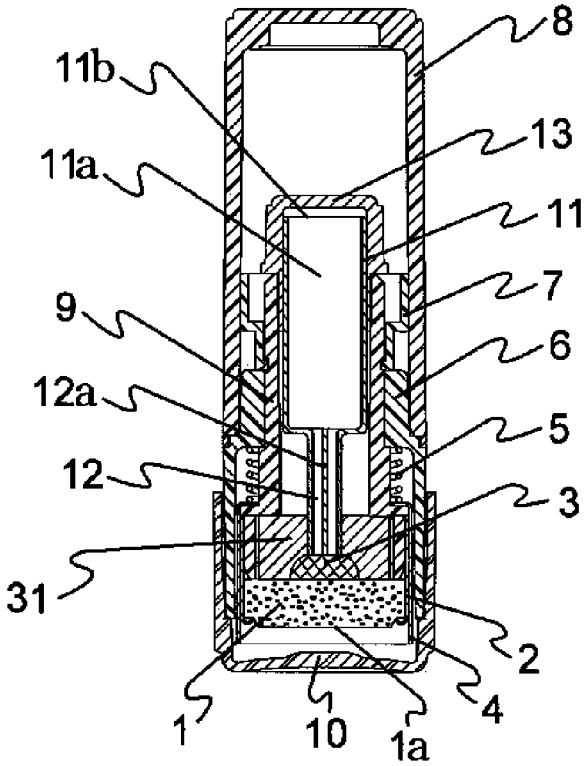
FIG. 24 is a schematic diagram illustrating another example of a plurality of ink supply tubes in the twelfth and thirteenth embodiments.
Figure 25:
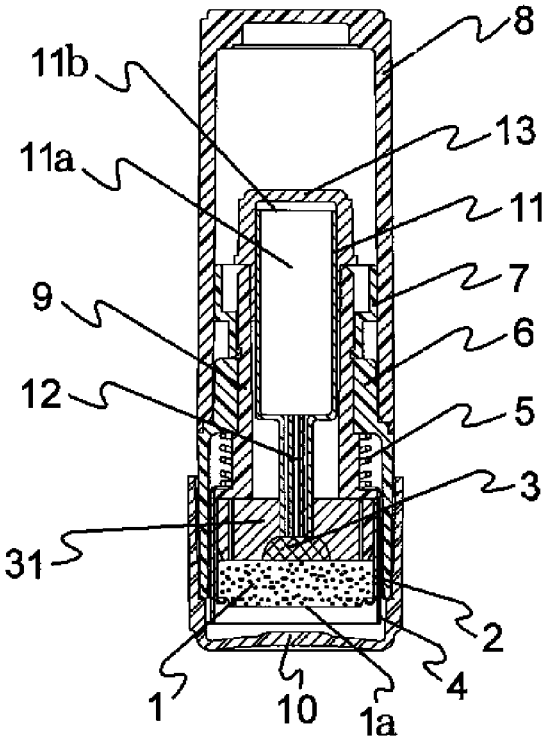
FIG. 25 is a schematic diagram illustrating yet another example of the ink supply tubes in the twelfth and thirteenth embodiments.

Next, based on FIGS. 23 to 25, a self-inking stamp according to a thirteenth embodiment of the present invention will now be described in detail. The following description will be made only about a difference from the aforementioned embodiments.

In the thirteenth embodiment, the ink supply tubes 12 are disposed on the side of the upper surface of the ink storage body 3, in such a manner that the distal end of each of the ink supply tubes 12 is connected to the upper surface of the ink storage body 3.

As a method for the connection, it is conceivable to pressingly insert the distal ends of the ink supply tubes 12 into the single body from the side of the upper surface thereof to form the ink storage body 3 around the distal ends of the ink supply tubes 12, so that the distal ends of the ink supply tubes 12 are connected to the ink storage body 3.

The self-inking stamp according to the thirteenth embodiment is configured as above. That is, except that the distal end of each of the ink supply tubes 12 is connected to the upper surface of the ink storage body 3, the thirteenth embodiment is the same as the twelfth embodiment.

Figure 26:
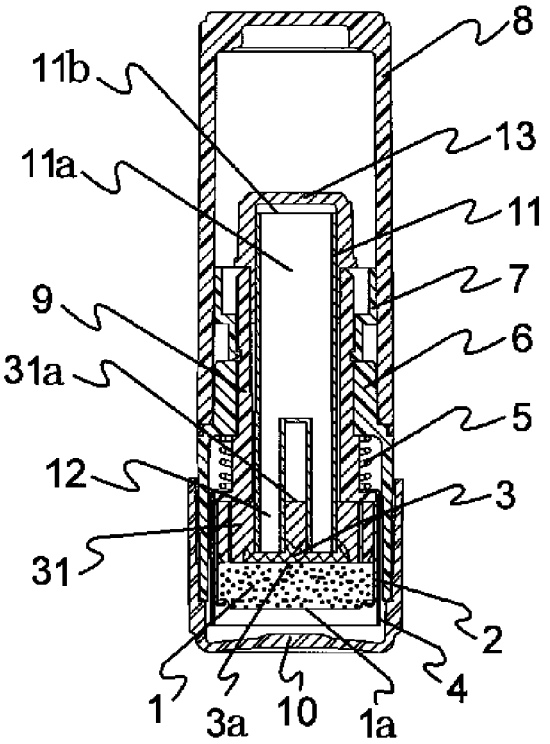
FIG. 26 is a schematic diagram illustrating a fourteenth embodiment of the present invention.

Next, based on FIG. 26, a self-inking stamp according to a fourteenth embodiment of the present invention will now be described in detail. The following description will be made only about a difference from the aforementioned embodiments.

In the fourteenth embodiment, the ink supply tubes 12 are disposed on the side of the upper surface of the ink storage body 2, in such a manner that the distal end of each of the ink supply tubes is connected to an inside of the ink storage body 3.

As a method for the connection, it is conceivable to pressingly insert the distal ends of the ink supply tubes 12 into the single body from the side of the upper surface thereof to form the ink storage body 3 around the distal ends of the ink supply tubes 12, in the same manner as that in the thirteenth embodiment, except that the distal ends of the ink supply tubes 12 are pressed strongly enough to allow each of the distal ends to intrude in the inside of the ink storage body 3.

The self-inking stamp according to the fourteenth embodiment is configured as above. That is, except that the distal end of each of the ink supply tubes 12 is connected to the inside of the ink storage body 3, the fourteenth embodiment is the same as the twelfth and thirteenth embodiments. In the fourteenth embodiment, the distal end of each of the ink supply tubes 12 is connected to the inside of the ink storage body 3, so that it becomes possible to provide stronger connection between each of the ink supply tubes 12 and the ink storage body 3.

Figure 27:
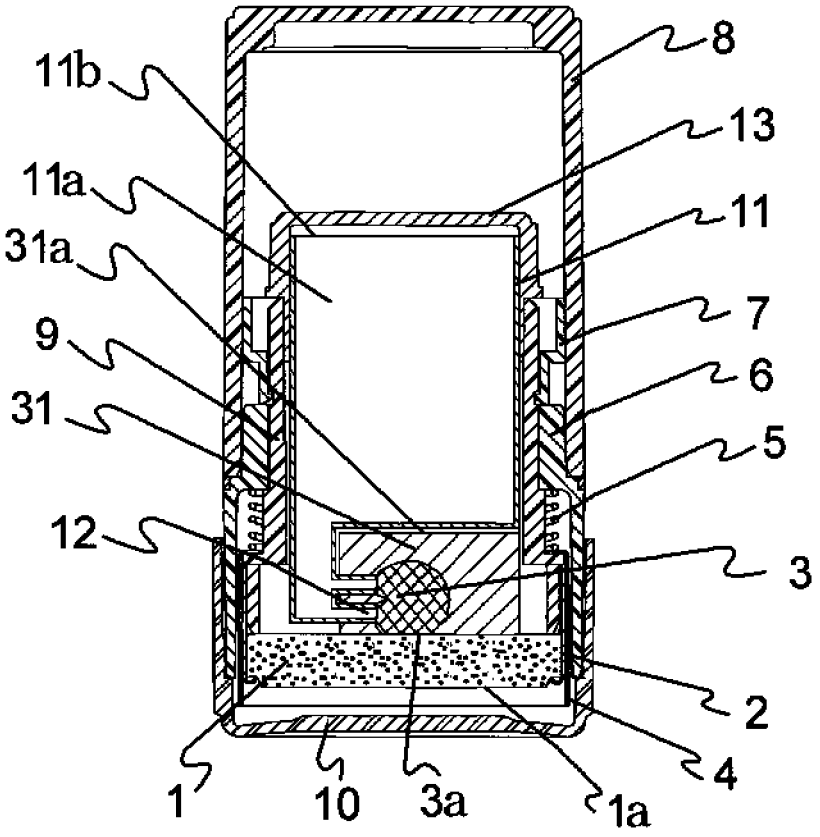
FIG. 27 is a schematic diagram illustrating a fifteenth embodiment of the present invention.

Next, based on FIGS. 27 and 28, a self-inking stamp according to a fifteenth embodiment of the present invention will now be described in detail. The following description will be made only about a difference from the aforementioned embodiments.

In the fifteenth embodiment, the ink supply tubes 12 are disposed on the side of the outer lateral peripheral surface of the ink storage body 3, in such a manner that the distal end of each of the ink supply tubes 12 is connected to the outer lateral peripheral surface of the ink storage body 3.

A method of forming the ink storage body 3 comprises pressingly inserting the distal ends of the ink supply tubes 12 into the single body from the side of an outer lateral peripheral surface thereof, so that a region of the single body around the distal ends of the ink supply tubes 12 is formed as the ink storage body 3.

The self-inking stamp according to the fifteenth embodiment is configured as above. That is, except that the distal end of each of the ink supply tubes 12 is connected to the outer lateral peripheral surface of the ink storage body 3, the fifteenth embodiment is the same as the twelfth and thirteenth embodiments.

Figure 28:
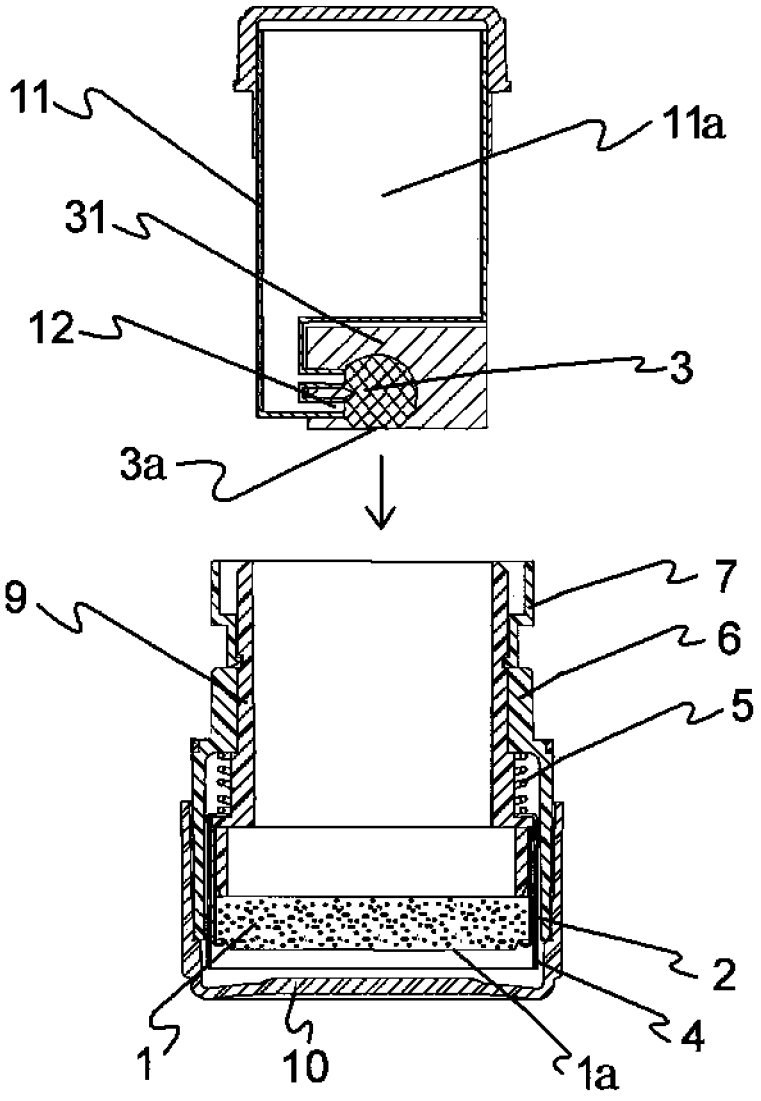
FIG. 28 is a schematic diagram illustrating an operation of attaching an ink tank, in the fifth embodiment.

As illustrated in FIG. 28, the self-inking stamp may be configured such that the ink storage body 3 and the absorber 31 can be replaced to new ones in conjunction with the ink replenish operation of: detaching the grip body 8; extracting the ink tank 11 with the ink tank cap 13 fitted thereon; and replacing the extracted ink tank 11 with a new ink tank.

Figure 29:
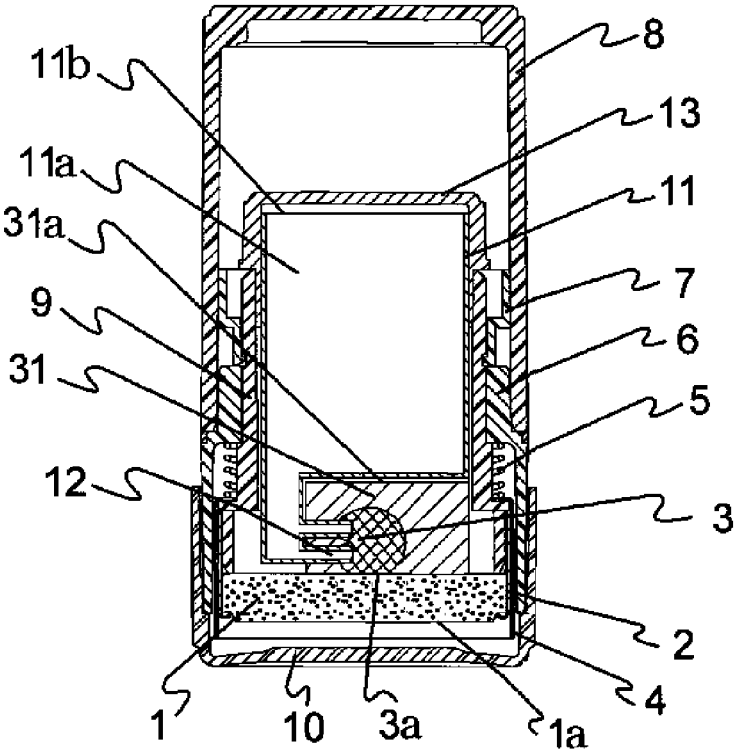
FIG. 29 is a schematic diagram illustrating a sixteenth embodiment of the present invention.
Figure 30:
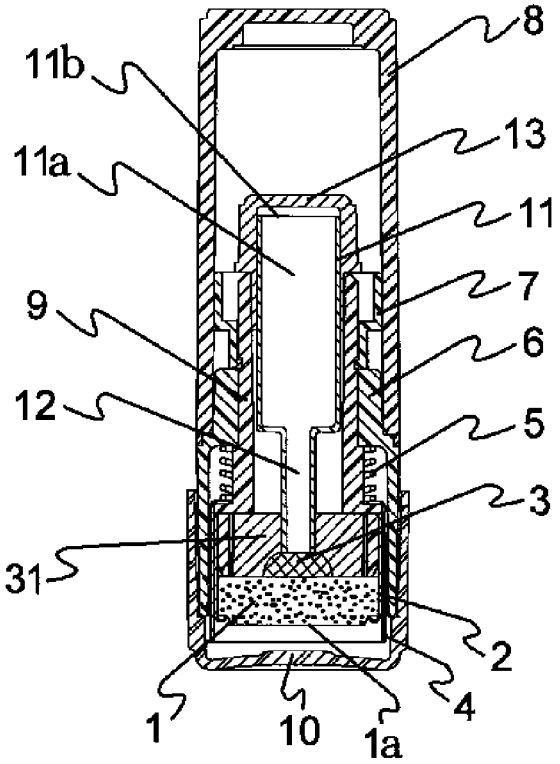
FIG. 30 is a schematic diagram illustrating a seventeenth embodiment of the present invention.
Figure 31:
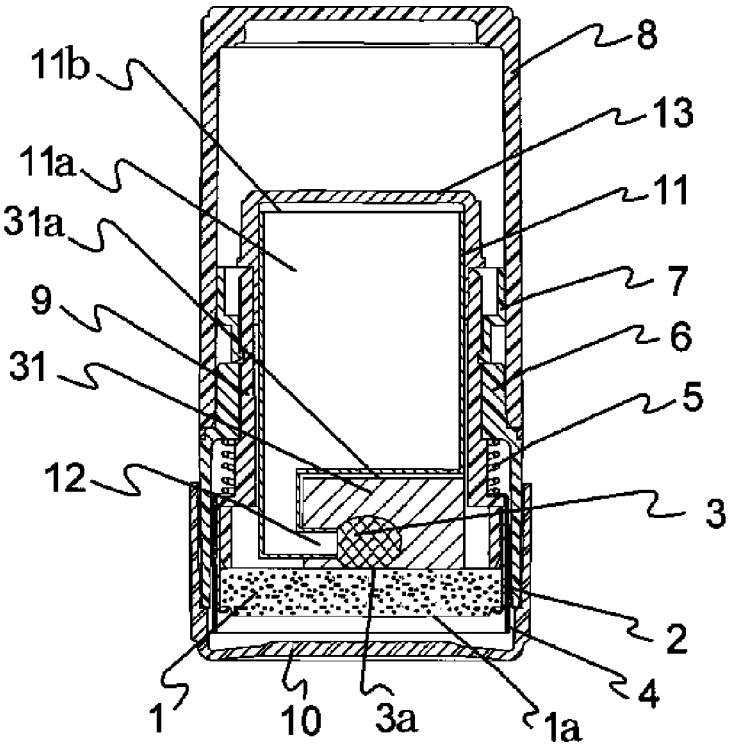
FIG. 31 is a schematic diagram illustrating another example of a plurality of ink supply tubes in the seventeenth embodiment.

Next, based on FIG. 29, a self-inking stamp according to a sixteenth embodiment of the present invention will now be described in detail. The following description will be made only about a difference from the aforementioned embodiments.

In the sixteenth embodiment, the ink supply tubes 12 are disposed on the side of the outer lateral peripheral surface of the ink storage body 3, in such a manner that the distal end of each of the ink supply tubes 12 is connected to the inside of the ink storage body 3.

As a method for the connection, it is conceivable to pressingly insert the distal ends of the ink supply tubes 12 into the single body from the side of the outer lateral peripheral surface thereof to form the ink storage body 3 around the distal ends of the ink supply tubes 12, in the same manner as that in the fifteenth embodiment, except that the distal ends of the ink supply tubes 12 are pressed strongly enough to allow each of the distal ends to intrude in the inside of the ink storage body 3.

The self-inking stamp according to the sixteenth embodiment is configured as above. That is, except that the distal end of each of the ink supply tubes 12 is connected to the inside of the ink storage body 3, the sixteenth embodiment is the same as the fifteenth embodiment. In the sixteenth embodiment, the distal end of each of the ink supply tubes 12 is connected to the inside of the ink storage body 3, so that it becomes possible to provide stronger connection between each of the ink supply tubes 12 and the ink storage body 3.

Next, based on FIGS. 30 to 33, a self-inking stamp according to a seventeenth embodiment of the present invention will now be described in detail. The following description will be made only about a difference from the aforementioned embodiments.

In the seventeenth embodiment, the number of the ink supply tubes 12 is set to one. As mentioned above, a cross-sectional shape of an outer or inner peripheral surface of the ink supply tube 12 may be a circular shape, an elliptical shape or a polygonal shape such as a triangular shape or a quadrangular shape. The distal end of the ink supply tube 12 may be opened downwardly in an up-down direction, or may be opened radially outwardly. Examples of a shape of the distal end of the ink supply tube 12 include an obliquely cut surface, a vertical surface, a conical surface and a convexedly curved surface.

In the seventeenth embodiment, a shape of the ink supply tube 12 is selected to allow the one ink supply tube 12 to perform both of the function of supplying ink contained in the ink tank 11, into the ink storage body 3 and the function of supplying external air into the ink tank 11.

The self-inking stamp according to the seventeenth embodiment is configured as above. Functions of this self-inking stamp will be described in detail below.

Except that both of the function of supplying ink contained in the ink tank 11, into the ink storage body 3 and the function of supplying external air into the ink tank 11 are performed by the one ink supply tube 12, the seventeenth embodiment is the same as the aforementioned embodiments.

Figure 32:
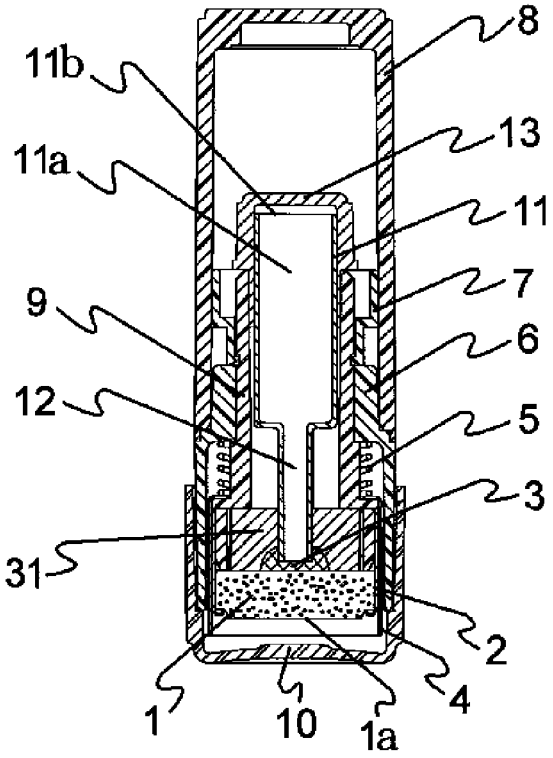
FIG. 32 is a schematic diagram illustrating another example of a connection method in the seventeenth embodiment.
Figure 33:
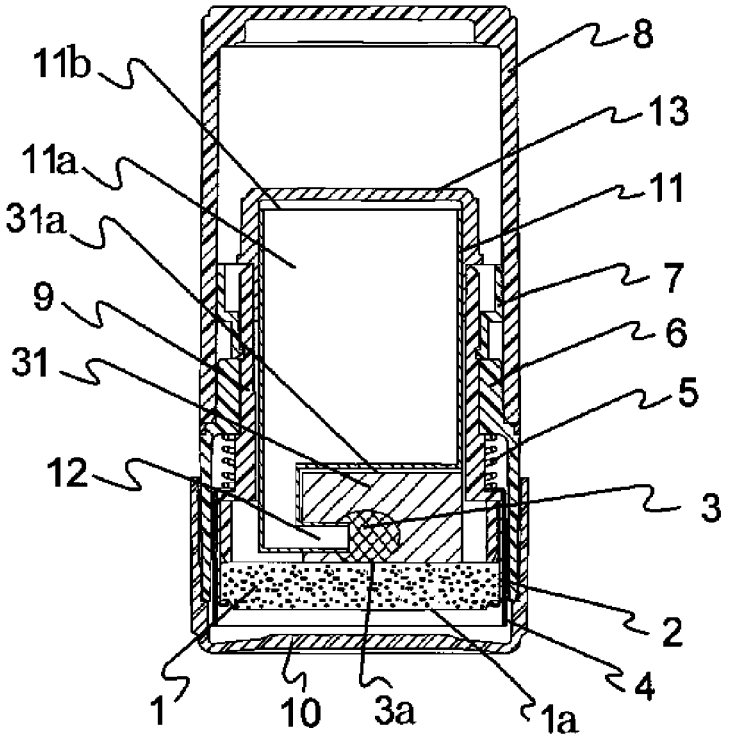
FIG. 33 is a schematic diagram illustrating yet another example of the connection method in the seventeenth embodiment.

Two examples of the seventeenth embodiment as combinations with the fourteenth and sixteenth embodiments are illustrated in FIGS. 32 and 33, respectively. In these examples, the distal end of the ink supply tube 12 is connected to the inside of the ink storage body 3, so that it becomes possible to provide stronger connection between the ink supply tube 12 and the ink storage body 3.

Figure 34:
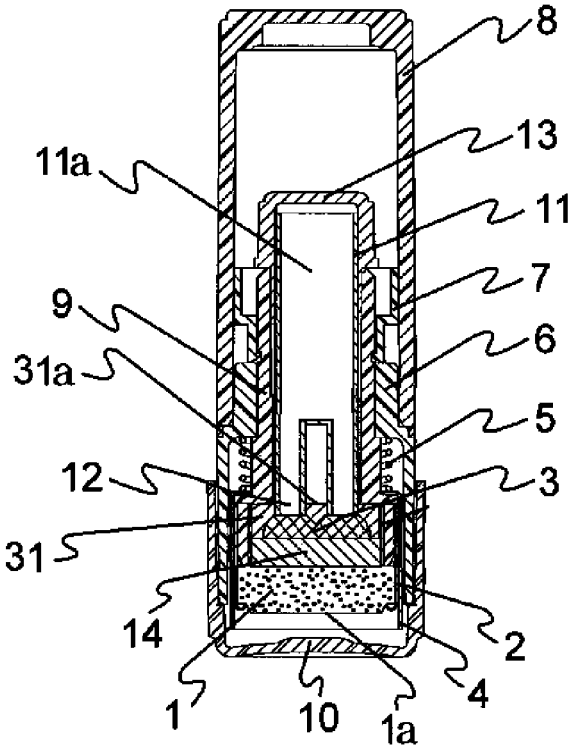
FIG. 34 is a schematic diagram illustrating an adjustor body employed in the twelfth embodiment.

In the aforementioned embodiments, an adjuster body 14 may be disposed between the porous marking block 1 and the ink storage body 3, to adjust a flow rate of ink with respect to the porous marking block 1, as illustrated in FIG. 34. Preferably, the adjuster body 14 is composed of a sintered body of a synthetic resin powder, having a sponge structure with appropriate hardness, such as polyvinyl acetal-based resin. In this case, the adjuster body 14 is capable of supplying an appropriate amount of ink to the porous marking block 1, so that it is useful for preventing stickiness of a marked impression. A relationship in terms of capillary force between respective ones of the porous marking block 1, the ink storage body 3 and the adjuster body 14 may be adjusted to allow an appropriate amount of ink to be moved to the marking surface 1*a*.

In the case where ink used has a relatively low viscosity, a capillary force of the adjuster body 14 is set to be greater than that of the porous marking block 1 to thereby increase an ink retention force. On the other hand, in the case where ink used has a relatively high viscosity, the capillary force of the adjuster body 14 is set to be less than that of the porous marking block 1 to thereby reduce the ink retention force. In this way, the movement of ink toward the porous marking block 1 may be adjusted.

Next, based on FIG. 35, a self-inking stamp according to an eighteenth embodiment of the present invention will now be described in detail. The following description will be made only about a difference from the aforementioned embodiments.

Figure 35:
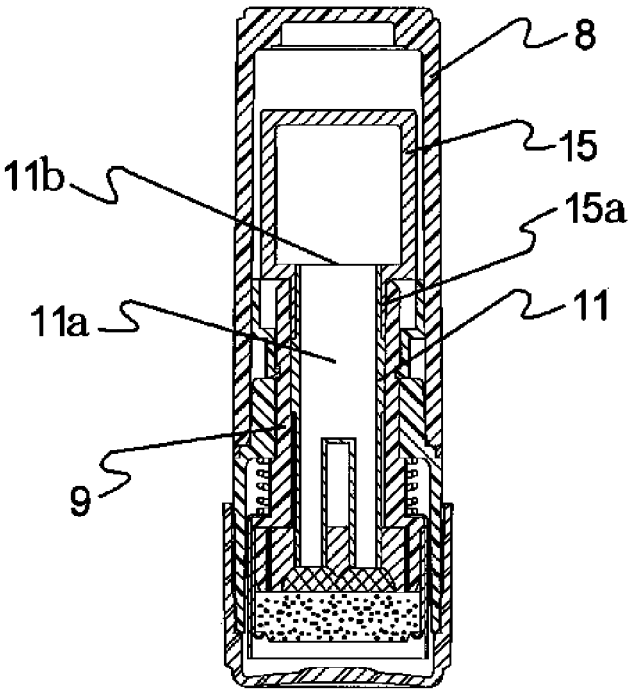
FIG. 35 is a schematic diagram illustrating an eighteenth embodiment of the present invention.

As illustrated in FIG. 35, the self-inking stamp according to the eighteenth embodiment comprises a replaceable ink cartridge 15 containing ink, in place of the ink tank cap 13, wherein the replaceable ink cartridge 15 is detachably and fittingly attached to the opening portion 11*b*. The replaceable ink cartridge 15 is composed of a bottomed tubular body having one end formed as an open end 15*a* which is configured to be detachably and fittingly attached to the opening portion 11*b*. Thus, as with the aforementioned embodiments, the opening portion 11*b* is hermetically sealed with respect to the outside by the open end 15*a* of the replaceable ink cartridge 15. As a result of the hermetical sealing, it becomes possible to prevent ink contained in the replaceable ink cartridge 15 from leaking to the outside. In this embodiment, a position where the opening portion 11*b* and the open end 15*a* are fittingly attached to each other may be identical to or may be different from a position for the hermetical sealing. As a fitting method for the fitting attachment, it is possible to employ various techniques, such as concave-convex fitting, press-fitting and screw fitting.

In this embodiment, in order to prevent the ink tank 11 from being disengaged from the stamp casing 9 during an operation of detaching the replaceable ink cartridge 15 from the ink tank 11, it is necessary that a fitting force between the ink tank 11 and the replaceable ink cartridge 15 is set to be less than a fitting force between the ink tank 11 and the stamp casing 9.

Further, before use, a cap (not illustrated) is fitted onto the open end 15*a*. Then, in use, after detaching the cap, the open end 15*a* is fittingly attached to the opening portion 11*b*. During this operation, in order to prevent leakage of ink from the replaceable ink cartridge 15, the open end 15*a* is fittingly attached to the opening portion 11*b*, while being maintained in a posture where an edge face of the open end 15*a* is oriented upwardly with respect to the ground.

The self-inking stamp according to the eighteenth embodiment is configured as above. Functions of this self-inking stamp will be described in detail below.

When the replaceable ink cartridge 15 is replaced with a new one because ink contained therein is fully consumed, the replaceable ink cartridge 15 is detached from the ink tank 11. During the detachment, the ink tank 11 is maintained in a state in which it is fitted in the stamp casing 9. Then, a new replaceable ink cartridge 15 is attached to the opening portion 11*b* of the ink tank 11, in a posture where the open end 15*a* serves as a leading end.

In the operation of attaching a new replaceable ink cartridge 15, after detaching a cap (not illustrated) from an open end 15*a* of the replaceable ink cartridge 15, the open end 15*a* is fittingly attached to the opening portion 11*b* of the ink tank 11, while being maintained in a posture where an edge face of the open end 15*a* is oriented upwardly with respect to the ground, so as to prevent leakage of ink from the replaceable ink cartridge 15.

Next, based on FIGS. 36, 37 and 20, a self-inking stamp according to a nineteenth embodiment of the present invention will now be described in detail. The following description will be made only about a difference from the aforementioned embodiments.

Figure 36:
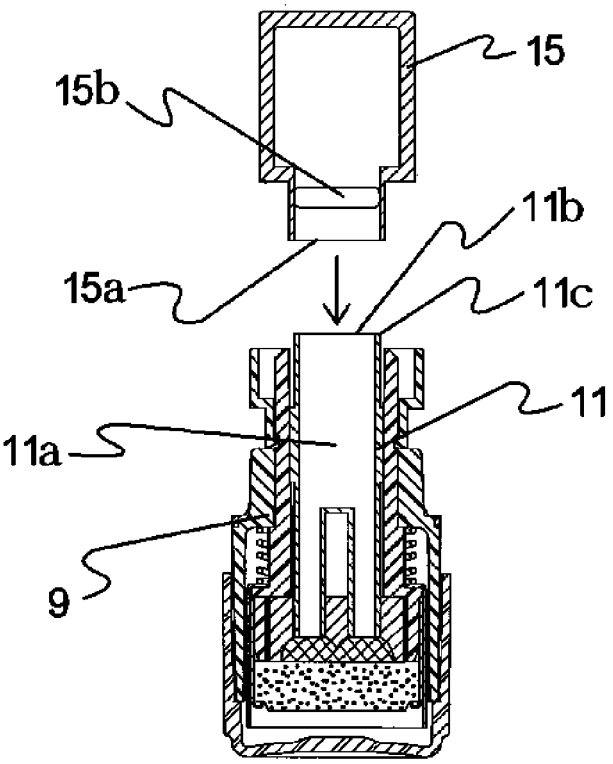
FIG. 36 is a schematic diagram illustrating an operation of attaching a replaceable ink cartridge, in a nineteenth embodiment of the present invention.
Figure 37:
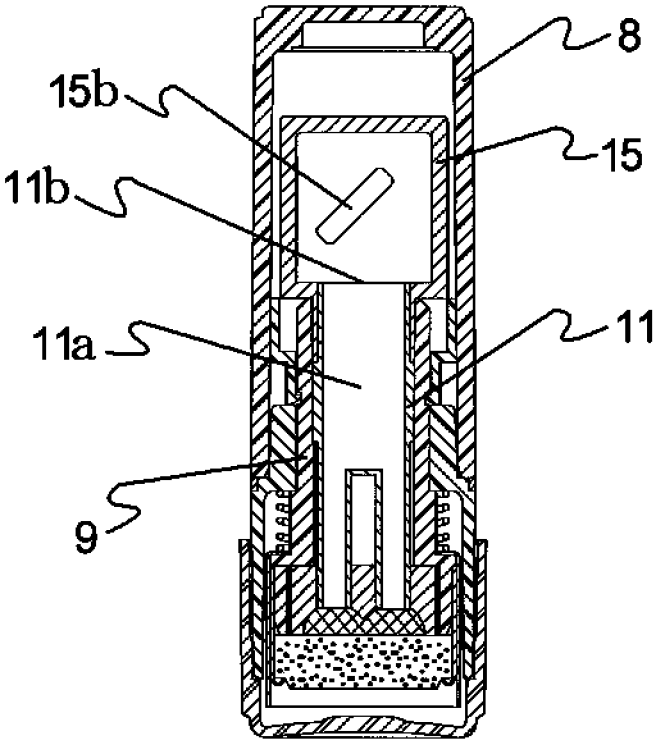
FIG. 37 is a schematic diagram illustrating the nineteenth embodiment.

As illustrated in FIGS. 36, 37 and 20, the self-inking stamp according to the nineteenth embodiment comprises a plate-shaped plug member 15*b* installed in the open end 15*a*, in addition to the components in the eighteenth embodiment. The plug member 15*b* is installed in the open end 15*a* of the replaceable ink cartridge 15 in such a manner as to close the open end 15*a* until the replaceable ink cartridge 15 is attached to the ink tank 11. Then, when the replaceable ink cartridge 15 is attached to the ink tank 11, the plug member 15*b* is pushed toward an inside of the opening portion 11*b* by a plug-member pushing member 11*c* provided in the opening portion 11*b* of the ink tank 11, and opened. In the nineteenth embodiment, as with the aforementioned embodiments, the opening portion 11*b* is hermetically sealed with respect to the outside by the open end 15*a* of the replaceable ink cartridge 15.

In order to prevent unexpected ink leakage, it is desirable that the plug member 15*b* is opened when, with respect to a position where a hermetically sealed state between the open end of the replaceable ink cartridge and the opening portion of the ink tank is established, the open end of the replaceable ink cartridge is slightly displaced while maintaining the hermetically sealed state. The plug-member pushing member 11*c* may be formed by utilizing an edge face of opening portion 11*b* without any modification, or may be formed by providing an additional protrusion.

As the plug member 15*b*, it is possible to select one of various types, such as a spherical-shaped member (FIG. 20A) and a lens-shaped member (FIG. 20B). Alternatively, the plug member 15*b* may be formed of a material, such as a film (not illustrated), breakable by the plug-member pushing member 11*c*.

The self-inking stamp according to the nineteenth embodiment is configured as above. Functions of this self-inking stamp will be described in detail below.

In the nineteenth embodiment where the plug member 15*b* is installed in the open end 15*a* of the replaceable ink cartridge 15, the plug member 15*b* is opened when being pushed by the plug-member pushing member 11*c* toward the inside of the replaceable ink cartridge 15. Thus, in the nineteenth embodiment, there is no risk of outflow of ink until the plug member is opened. Thus, it is not necessary to maintain the open end 15*a* in a posture where an edge face of the open end 15*a* is oriented upwardly with respect to the ground, as in the eighteenth embodiment. That is, the open end 15*a* can be attached, irrespective of whether the edge face of the open end 15*a* is oriented upwardly, downwardly or laterally. When the plug member 15*b* is formed of a breakable material such as a film, it will be broken by the plug-member pushing member 11*c* and opened.

Next, based on FIGS. 38 and 39, a self-inking stamp according to a twentieth embodiment of the present invention will now be described in detail. The following description will be made only about a difference from the aforementioned embodiments.

Figure 38:
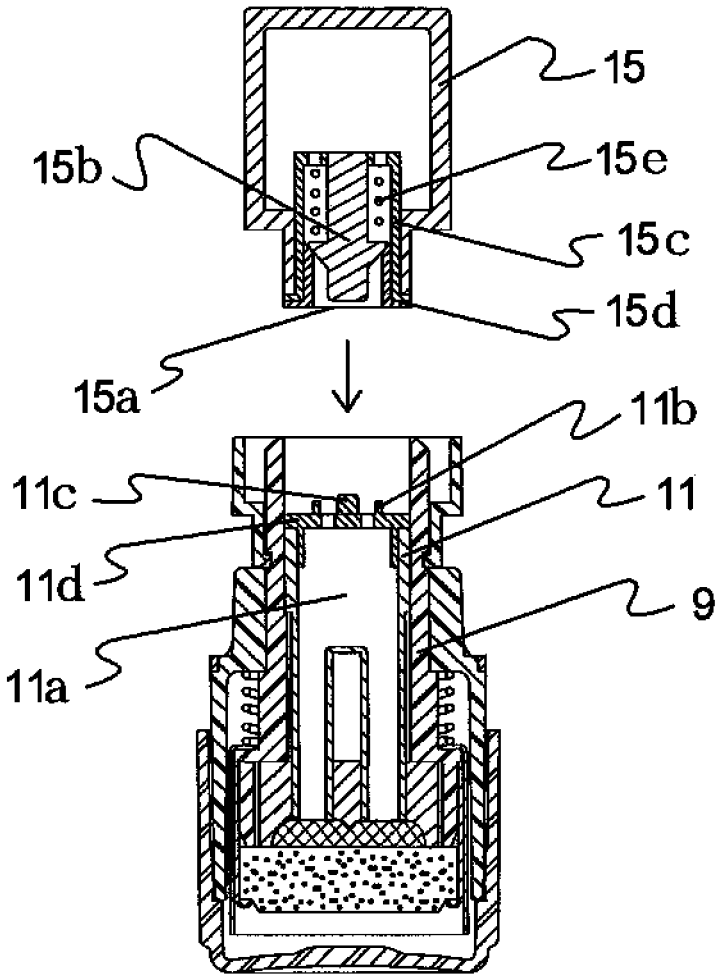
FIG. 38 is a schematic diagram illustrating an operation of attaching a replaceable ink cartridge, in a twentieth embodiment of the present invention.
Figure 39:
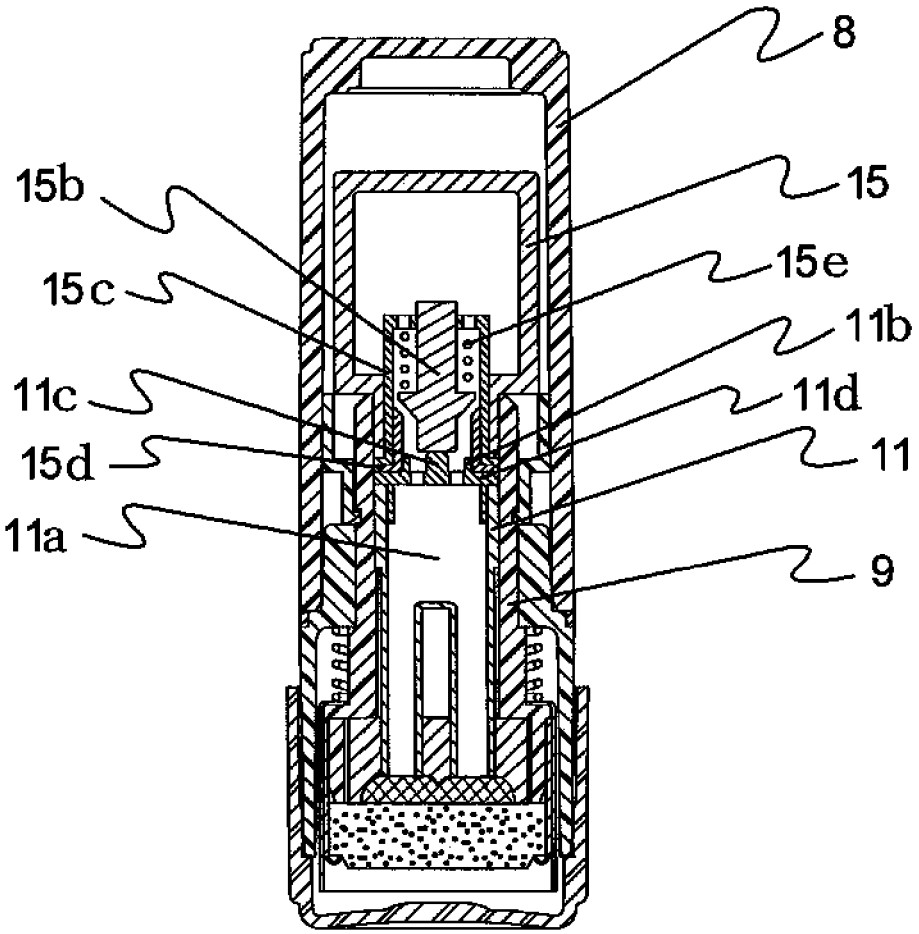
FIG. 39 is a schematic diagram illustrating the twentieth embodiment.

As illustrated in FIGS. 38 and 39, the self-inking stamp according to the twentieth embodiment comprises a valve device installed in the open end 15*a* of the replaceable ink cartridge 15 and configured such that an aftermentioned plug member 15*b* is opened when being pushed by the plug-member pushing member 11*c*, and closed when being separated from the plug-member pushing member 11*c*, in addition to the components in the eighteenth embodiment.

The valve device comprises a tubular valve casing 15*c*, a cap member 15*d*, a plug member 15*b*, and a coil spring 15*e*. In a state in which the plug member 15*b* is installed inside the tubular valve casing 15*c* through the coil spring 15*e*, the cap member 15*d* is fitted in an opening portion of the tubular valve casing 15*c*. An inner periphery of an ink outlet hole provided in the cap member 15*d* is formed as a valve seat portion engageable with a valve element provided on the plug member 15*b*. In the separated state, the valve element of the plug member 15*b* is pressed against the valve seat portion of the cap member 15*d* in a close contact manner by a spring force of the coil spring 15*e*.

When the plug member 15*b* is pushed upwardly by the plug-member pushing member 11*c*, the plug member 15*b* is moved upwardly against the spring force of the coil spring 15*e*, so that the close contact state between the valve element and the valve seat portion is released, and thereby ink contained in the replaceable ink cartridge 15 flows into the ink tank 11. Then, when the pushing by the plug-member pushing member 11*c* is released, the valve element is pressed against and brought into close contact with the valve seat portion of the cap member 15*d* again by the spring force of the coil spring 15*e*, so that the plug member 15*b* is closed.

The plug-member pushing member 11*c* may be integrally provided together with the ink tank 11, or may be provided as a separate component, as illustrated in FIGS. 21 and 22. When the plug-member pushing member 11*c* is provided as a separate component, an inner cap 11*d* is attached to the opening portion 11*b* of the ink tank 11, wherein the plug-member pushing member 11*c* is provided on an upper wall of the inner cap 11*d*, and the opening portion 11*b* is provided in the upper wall of the inner cap 11*d* at a position around the plug-member pushing member 11*c*. Then, the open end 15*a* of the replaceable ink cartridge 15 is detachably and fittingly attached to the opening portion 11*b* of the ink tank 11. As with the aforementioned embodiments, the opening portion 11*b* is hermetically sealed with respect to the outside by the open end 15*a* of the replaceable ink cartridge 15.

The self-inking stamp according to the twentieth embodiment is configured as above. Functions of this self-inking stamp will be described in detail below.

In the valve device configured such that the plug member 15*b* is opened when being pushed by the plug pushing member 11*c*, the open end 15*a* can be attached without any restriction on orientation of the edge face thereof. That is, the open end 15*a* can be attached, irrespective of whether the edge face of the open end 15*a* is oriented upwardly, downwardly or laterally.

In an operation of detaching an old replaceable ink cartridge 15 from the ink tank 11 so as to be replaced with a new replaceable ink cartridge 15, when ink remains in the old replaceable ink cartridge 15, the remaining ink is likely to leak to the outside. However, in the self-inking stamp using the valve device, even when an old replaceable ink cartridge 15 is detached from the ink tank 11, the open end 15*a* is closed by the action of the valve device, so that it becomes possible to prevent ink leakage.

Although the eighteenth to twentieth embodiments have been described based on the configuration in the thirteenth embodiment, it is to be understood that the eighteenth to twentieth embodiments may be implemented in each of the fourteenth to seventeenth embodiments.

Although the present invention has been fully described by way of the above embodiments, it is to be understood that various changes and modifications may be made therein without departing from the spirit and scope thereof as set forth in appended claims.

What is claimed is:

1. A self-inking stamp comprising:

a porous marking block having a large number of interconnected pores;

an ink storage body disposed on an upper surface of the porous marking block;

an ink tank comprising a tank body having an inner space for containing ink, and at least one ink supply tube extending from a wall of the tank body and having an open distal end connected to the ink storage body to join the ink supply tube and the ink storage body together, the at least one ink supply tube providing communication only between the inner space of the tank body and the ink storage body, the at least one ink supply tube being configured to gravitationally supply ink from the tank body to the ink storage body; and an absorber disposed on an upper surface of the ink storage body and configured to generate a capillary force less than that of the ink storage body, and absorb excess ink from the ink storage body, the absorber having an air passage opening provided in at least a part of an upper surface or outer lateral peripheral surface thereof in communicating relation with atmospheric air.

2. The self-inking stamp as defined in claim 1, which further comprises a wall member covering an entire outer lateral peripheral surface of the ink storage body and having an ink outlet opening provided in a lower surface thereof, the wall member being composed of a fibrous body or a porous body which is configured to generate a capillary force less than that of the ink storage body and allow air to pass therethrough, and disposed in such a manner that a lower surface of the fibrous body or the porous body is in contact with the upper surface of the porous marking block.

3. The self-inking stamp as defined in claim 2, wherein the wall member is composed of a barrier body capable of blocking ink, and disposed in such a manner that a lower surface of the barrier body is in contact with the upper surface of the porous marking block.

4. The self-inking stamp as defined in claim 1, wherein the at least one ink supply tube is disposed on the side of the upper surface of the ink storage body, in such a manner that the distal end of the at least one ink supply tube is connected to the upper surface of the ink storage body.

5. The self-inking stamp as defined in claim 1, wherein the at least one ink supply tube is disposed on the side of the upper surface of the ink storage body, in such a manner that the distal end of the at least one ink supply tube is connected to an inside of the ink storage body.

6. The self-inking stamp as defined in claim 1, wherein the at least one ink supply tube is disposed on the side of an outer lateral peripheral surface of the ink storage body, in such a manner that the distal end of the at least one ink supply tube is connected to the outer lateral peripheral surface of the ink storage body.

7. The self-inking stamp as defined in claim 1, wherein the at least one ink supply tube is disposed on the side of an outer lateral peripheral surface of the ink storage body, in such a manner that the distal end of the at least one ink supply tube is connected to an inside of the ink storage body.

8. The self-inking stamp as defined in claim 1, which further comprises a replaceable ink cartridge containing ink and having an open end, wherein the ink tank has an opening portion at an upper end thereof, and wherein the open end of the replaceable ink cartridge is detachably and fittingly attached to the opening portion of the ink tank in such a manner as to hermetically seal the opening portion.

9. The self-inking stamp as defined in claim 8, wherein the replaceable ink cartridge comprises a plug member installed in the open end thereof and configured to be opened when the open end of the replaceable ink cartridge is fittingly attached to the opening portion of the ink tank.

10. The self-inking stamp as defined in claim 9, wherein the replaceable ink cartridge comprises a plug member installed in the open end thereof and configured to be closed when the open end of the replaceable ink cartridge is detached from the opening portion of the ink tank.

11. A method of producing a self-inking stamp, wherein the self-inking stamp comprises: a porous marking block having a large number of interconnected pores; an ink storage body disposed on an upper surface of the porous marking block; an ink tank comprising an ink supply tube having an open distal end connected to the ink storage body; and an absorber disposed on an upper surface of the ink storage body and configured to generate a capillary force less than that of the ink storage body, and absorb excess ink from the ink storage body, the absorber having an air passage opening provided in at least a part of an upper surface or outer lateral peripheral surface thereof in communicating relation with atmospheric air, characterized in that the method further comprising: preparing a single body for the ink storage body and the absorber by using a same material; and inwardly pressing the single body by the ink supply tube, to thereby form the ink storage body and the absorber, wherein the ink storage body is pressed by a pressing force greater than that for the absorber.

12. The method as defined in claim 11, wherein the distal end of the ink supply tube is pressingly inserted into the single body from the side of an upper surface of the single body, whereby the ink supply tube is disposed on the side of the upper surface of the ink storage body, in such a manner that the distal end of the ink supply tube is connected to the upper surface of the ink storage body.

13. The method as defined in claim 11, wherein the distal end of the ink supply tube is pressingly inserted into the single body from the side of an upper surface of the single body, whereby the ink supply tube is disposed on the side of the upper surface of the ink storage body, in such a manner that the distal end of the ink supply tube is connected to an inside of the ink storage body.

14. The method as defined in claim 11, wherein the distal end of the ink supply tube is pressingly inserted into the single body from the side of an outer lateral peripheral surface of the single body, whereby the ink supply tube is disposed on the side of the outer lateral peripheral surface of the ink storage body, in such a manner that the distal end of the ink supply tube is connected to the outer lateral peripheral surface of the ink storage body.

15. The method as defined in claim 11, wherein the distal end of the ink supply tube is pressingly inserted into the single body from the side of an outer lateral peripheral surface of the single body, whereby the ink supply tube is disposed on the side of the outer lateral peripheral surface of the ink storage body, in such a manner that the distal end of the ink supply tube is connected to an inside of the ink storage body.

16. The method as defined in claim 11, wherein the number of the ink supply tubes is one, or two or more.

17. The method as defined in claim 11, wherein the self-inking stamp further comprises a replaceable ink cartridge containing ink and having an open end, and wherein the method comprising: providing an opening portion at an upper end of the ink tank; and detachably and fittingly attaching the open end of the replaceable ink cartridge to the opening portion of the ink tank in such a manner as to hermetically seal the opening portion.

18. The method as defined in claim 17, wherein the replaceable ink cartridge comprises a plug member installed in the open end thereof and configured to be opened when the open end of the replaceable ink cartridge is fittingly attached to the opening portion of the ink tank.

19. The method as defined in claim 18, wherein the replaceable ink cartridge comprises a plug member installed in the open end thereof and configured to be closed when the open end of the replaceable ink cartridge is detached from the opening portion of the ink tank.

20. The self-inking stamp as defined in claim 1, wherein the ink tank has a sealed upper end.

* * * * *